US008297730B2

(12) United States Patent
Kuwahara

(10) Patent No.: US 8,297,730 B2
(45) Date of Patent: Oct. 30, 2012

(54) LIQUID DISCHARGE APPARATUS AND LIQUID DISCHARGE METHOD

(75) Inventor: Soichi Kuwahara, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/405,055

(22) Filed: Mar. 16, 2009

(65) Prior Publication Data

US 2009/0179931 A1 Jul. 16, 2009

Related U.S. Application Data

(63) Continuation of application No. 10/466,661, filed as application No. PCT/JP02/12181 on Nov. 21, 2002, now abandoned.

(30) Foreign Application Priority Data

Nov. 26, 2001 (JP) ..... 2001-359852

(51) Int. Cl.
*B41J 2/205* (2006.01)
*B41J 29/38* (2006.01)

(52) U.S. Cl. ..... 347/15; 347/5

(58) Field of Classification Search ..... 347/5, 13, 347/15

See application file for complete search history.

(56) References Cited

U.S. PATENT DOCUMENTS

| | | | |
|---|---|---|---|
| 5,610,637 | A | 3/1997 | Sekiya et al. |
| 6,027,203 | A | 2/2000 | Campbell |
| 6,315,380 | B1 | 11/2001 | Yokoi et al. |
| 6,328,395 | B1 | 12/2001 | Kitara et al. |
| 6,631,963 | B1 | 10/2003 | Ando et al. |

FOREIGN PATENT DOCUMENTS

| | | | |
|---|---|---|---|
| EP | 1 025 999 | A2 | 8/2000 |
| EP | 1 025 999 | A3 | 3/2001 |
| EP | 1157844 | A1 | 11/2001 |
| JP | 06-297717 | | 10/1994 |
| JP | 09-254412 | | 9/1997 |
| JP | 10166558 | | 6/1998 |
| JP | 2000-062148 | | 2/2000 |
| JP | 2000-94753 | | 4/2000 |
| WO | WO 01/39981 | | 6/2001 |

*Primary Examiner* — Geoffrey Mruk

(74) *Attorney, Agent, or Firm* — Robert J. Depke; Rockey, Depke & Lyons, LLC

(57) ABSTRACT

A liquid discharge apparatus includes a liquid discharge head (120) having ink discharge nozzles (203) for discharging droplets of inks, and a head controller (162) for controlling the liquid discharge head to discharge droplet from liquid discharge units onto the surface of recording paper (P), wherein the liquid discharge head includes the plural liquid discharge heads in a direction perpendicular to movement direction of recording paper where the recording paper is relatively moved with respect to the liquid discharge head. The head controller serves to allow discharge timings of droplets in movement direction of the recording paper to be different every one pixel in movement direction of the recording paper to eliminate stripes apt to take place when a portion or the entirety of image is printed by one scanning operation to obtain image having less defect.

10 Claims, 35 Drawing Sheets

IMPACT POSITION

ENLARGEMENT OF STRIPE BY SURFACE TENSION OF INK

PNM8

LIQUID DISCHARGE APPARATUS AND LIQUID DISCHARGE METHOD

The subject matter of application Ser. No. 10/466,661, is incorporated herein by reference. The present application is a Continuation of U.S. Ser. No. 10/466,661, filed Jul. 18, 2003, which is a 371 U.S. National Stage filing of PCT application PCT/JP2002/12181, filed Nov. 21, 2002, which claims priority to Japanese Patent Application Number JP 2001-359852, filed Nov. 26, 2001. The present application claims priority to these previously filed applications.

TECHNICAL FIELD

The present invention relates to a liquid discharge apparatus provided with plural liquid discharge units, and relates to a liquid discharge apparatus and a liquid discharge method adapted so that stripes apt to take place when a portion of image or the entirety thereof is printed by one scanning operation is caused to become difficult to be conspicuous to obtain picture quality having less defect.

The present application claims priority of Japanese Patent Application No. 2001-359852, filed on Nov. 26, 2001, the entirety of which is incorporated by reference herein.

BACKGROUND ART

In recent years, liquid discharge apparatuses adapted for discharging ink droplet from an ink discharge unit to carry out recording with respect to recording paper, e.g., ink jet printers have been popularized. In such ink jet printers, ink jet printers of the type which discharge ink droplet while moving, in a direction perpendicular to paper feed direction, recording head in which ink discharge units are arranged at several millimeter width in paper feed direction are widely popularized. Hereinafter, such recording head will be called serial head.

In ink jet printers of such serial head type, it is necessary to print one image by several scanning operations. As a result, it takes much time for completing printing. Such printers have the problems that the number of scanning operations of the head is many so that burden is applied to the apparatus, and occurrence frequency of noise is increased, etc.

In view of the above, it is conceivable to use ink jet printer in which plural ink discharge units are arranged in a direction perpendicular to paper feed direction, e.g., ink jet printer of the type in which a large number of ink discharge units are arranged within the range equivalent to print range in a direction perpendicular to the paper feed direction, or within a range broader than that range to print image by one paper feed, i.e., one scanning operation in head relative movement direction. Hereinafter, head of the type in which a large number of ink discharge units are arranged in a direction perpendicular to the paper feed direction, and recording paper is relatively moved in one direction with respect to the recording head will be called line head. In the line head, there are the type in which recording head is fixed and recording paper is moved, and the type in which recording paper is fixed and recording head is moved.

Meanwhile, picture quality required for the ink jet printer has been improved year by year, and realization of high resolution has been advanced. In accordance with such circumstances, size of ink droplet to be discharged also has become small.

In accordance with realization of high resolution of image to be printed and change into very small ink liquid droplet, realization of high accuracy is required also with respect to impact position of ink droplet, i.e., formation position of dots on recording paper. In the ink jet printer, there are instances where impact position of ink droplet may deviate (be shifted) from the primary position by influence such as accuracy of ink discharge unit and/or state of nozzle surface constituting the ink discharge unit, etc. With respect to such positional shift, there are some positional shifts taking place at random every time, but positional shift resulting from accuracy of the ink discharge unit, etc. is peculiar to respective discharge units.

Accordingly, when image is printed by one scanning operation by means of line head, tendency of positional shift peculiar to respective ink discharge units is maintained from the first to the last. For this reason, particularly when impact position is shifted to the ink discharge unit arrangement direction, stripes take place along print direction as shown in FIG. 17 which will be described later.

In the case where dot diameter is sufficiently small as compared to resolution, such stripes are difficult to be conspicuous because the portion of white ground is many. However, in the case of dot diameter equivalent to pitch of pixel or slightly greater than that, such stripes are divided into the portions of white stripe and the portions which are not the white stripe so that they become conspicuous.

In this case, there are also instances where inks are pulled against each other so that shift of impact position is further enlarged as shown in FIG. 18 which will be described later independency upon property of ink and paper.

This problem similarly takes place even in the case of the serial head without being limited to the line head. In this case, in the serial head, with respect to this problem, without printing print direction same line only by one ink discharge unit, paper feed quantity is controlled to print the same line in the print direction by using plural different ink discharge units, or to carry out print by one scanning operation thereafter to carry out scanning operations several times in such a manner to fill space of print result to carry out print so that such stripes are caused to be difficult to be conspicuous.

In this method, there were drawbacks that because the number of scanning operations of head required for print is increased, it takes much time, burden is applied to the apparatus, occurrence frequency of noise is further increased, and data for driving head must be complicatedly sorted, etc.

In the case of the line head, the greatest merit that print can be made by one scanning operation would not be exhibited.

DISCLOSURE OF THE INVENTION

An object of the present invention is to provide a novel liquid discharge apparatus and a novel liquid discharge method which can solve problems that conventional ink jet printers as described above have.

Another object of the present invention is to provide a liquid discharge apparatus and a liquid discharge method adapted so that when a portion or the entirety of image is printed by one scanning operation by using plural liquid discharge units, stripe resulting from shift of impact position of droplet, etc. is permitted to become difficult to be conspicuous.

A liquid discharge apparatus according to the present invention is directed to a liquid discharge apparatus including a liquid discharge head having a liquid discharge unit for discharging droplet, and liquid discharge head control means for controlling the liquid discharge head to discharge droplet from the liquid discharge unit onto recording medium surface, wherein the liquid discharge head includes plural liquid discharge units in a direction perpendicular to movement direction of a recording medium where the recording medium is relatively moved with respect to the liquid discharge head, and the liquid discharge control means serves to allow discharge timings of droplet in movement direction of the recording medium to be different every one pixel in the movement direction of the recording medium.

Another liquid discharge apparatus according to the present invention is directed to a liquid discharge apparatus including liquid discharge heads each having a liquid discharge unit for discharging droplet by plural colors, and including liquid discharge head control means for controlling the liquid discharge heads of respective colors to discharge droplets of respective colors from the liquid discharge units of respective colors onto recording medium surface to thereby carry out color image formation, wherein the liquid discharge heads of respective colors include plural liquid discharge units of respective colors in a direction perpendicular to movement direction of a recording medium where the recording medium is relatively moved with respect to the liquid discharge heads, and the liquid discharge head control means of respective colors serves to allow discharge timings of droplets of respective colors in the movement direction of the recording medium to be different in accordance with respective colors every one pixel in the movement direction of the recording medium.

A liquid discharge method according to the present invention is directed to a liquid discharge method in which plural liquid discharge units are provided in a direction perpendicular to movement direction of a recording medium where the recording medium is relatively moved with respect to the a liquid discharge head to thereby discharge droplet from the liquid discharge unit onto recording medium surface, the liquid discharge method comprising: a step of constituting droplet per one pixel by plural number of liquid discharge operations; and a control step of allowing discharge timings of plural liquid discharge operations constituting liquid per one pixel to be different every one pixel in the movement direction of the recording medium.

Another liquid discharge method according to the present invention is directed to a liquid discharge method in which plural liquid discharge units are provided in a direction perpendicular to movement direction of a recording medium where the recording medium is relatively moved with respect to a liquid discharge head to thereby discharge droplet from the liquid discharge unit onto recording medium surface, the liquid discharge method comprising: a step of constituting droplet per one pixel; and a control step in which in the case where droplet per one pixel is constituted by liquid quantity of droplet determined in advance, discharge timings of droplets per one pixel are caused to be different every one pixel in the movement direction of the recording medium.

A further liquid discharge method according to the present invention is directed to a liquid discharge method in which plural liquid discharge units are provided in a direction perpendicular to movement direction of a recording medium where the recording medium is relatively moved with respect to a liquid discharge head and the liquid discharge units are included by plural colors to thereby discharge droplets of respective colors from the liquid discharge units of respective colors onto recording medium surface to carry out color image formation, the liquid discharge method comprising a control step of allowing discharge timings of droplets of respective colors to be different in accordance with respective colors every one pixel in the movement direction of the recording medium.

Namely, in the present invention, in the liquid discharge apparatus and the liquid discharge method adapted so that when printing is carried out by one scanning operation, stripes are apt to be conspicuous along print direction by a certain pattern, liquid discharge head, e.g., recording head of ink jet printer is controlled in such a manner to shift discharge timings of droplets, e.g., ink droplets every one pixel in movement direction of recording medium relatively moved with respect to the liquid discharge head, e.g., paper feed direction, and in the direction where the movement direction of the recording medium is in correspondence with the print direction. In accordance with the present invention, impact position of droplet, e.g., ink droplet is changed to thereby have ability to change position of dots formed by droplet on recording medium, e.g., recording paper. Thus, dots of two pixels are connected so that there can result one large dot. As a result, stripes are permitted to become difficult to be conspicuous. It is to be noted that even in the case of dot size where stripe is apt to be conspicuous by a certain pattern, since it is rare that dots are continuously hit in print direction when thin dot pattern where stripe is difficult to be conspicuous is printed, there is hardly possibility that two dots are connected. Namely, printing can be carried out by primary dot diameter. On the contrary, in the case of dot pattern like solid plane portion where stripe is apt to be conspicuous, two dots are automatically connected so that there results large dot where stripe is not conspicuous. Accordingly, stripes are permitted to become difficult to be conspicuous.

In the liquid discharge apparatus adapted so that dot diameter within pixel can be changed by discharge of different liquid quantities, or discharge different in number per one pixel, liquid discharge head is controlled in such a manner to shift discharge timings every one pixel in movement direction of recording medium, e.g., print direction only at dot diameter where stripes are apt to be conspicuous by a certain pattern. Thus, dots of two pixels are connected so that there results one large dot, thereby permitting stripes to be difficult to be conspicuous. In this case, in the case of dot diameter where stripes are not primarily conspicuous, one dot is hit with respect to one pixel as in the prior art, thereby making it possible to prevent deterioration of resolution.

In the case of color print, a way of shifting discharge timing may be also varied by color. Thus, the position where two dots are connected so that there results large one dot may be also shifted. By this method, it is possible to reduce occurrence of the problem such that liquids, e.g., inks are concentrated on one portion, so liquids of different colors, e.g., inks of different colors are stained with each other.

Still more further objects of the present invention and practical merits obtained by the present invention will become more apparent from the description of the embodiments which will be given below with reference to the attached drawings.

BEST MODE FOR CARRYING OUT THE INVENTION

Figure 1:
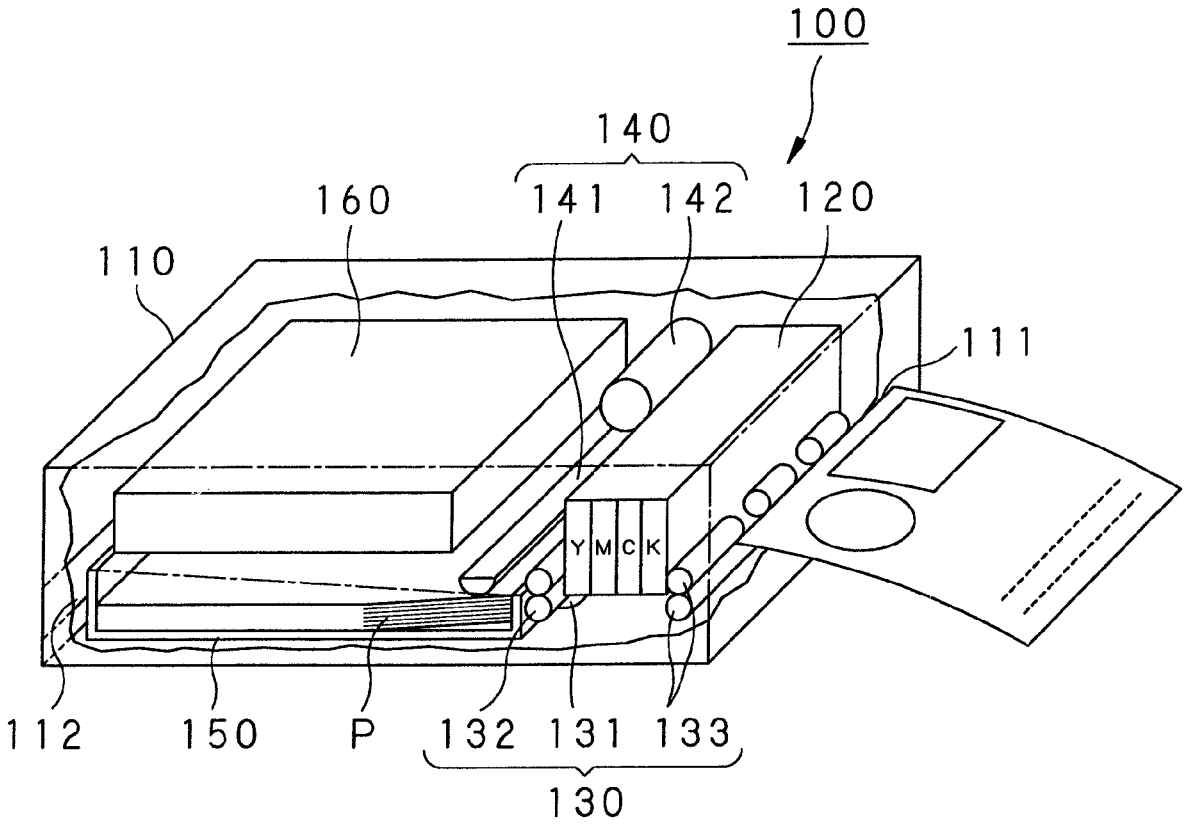
FIG. 1 is a perspective view showing an ink jet printer to which the present invention is applied using line head.
Figure 2:
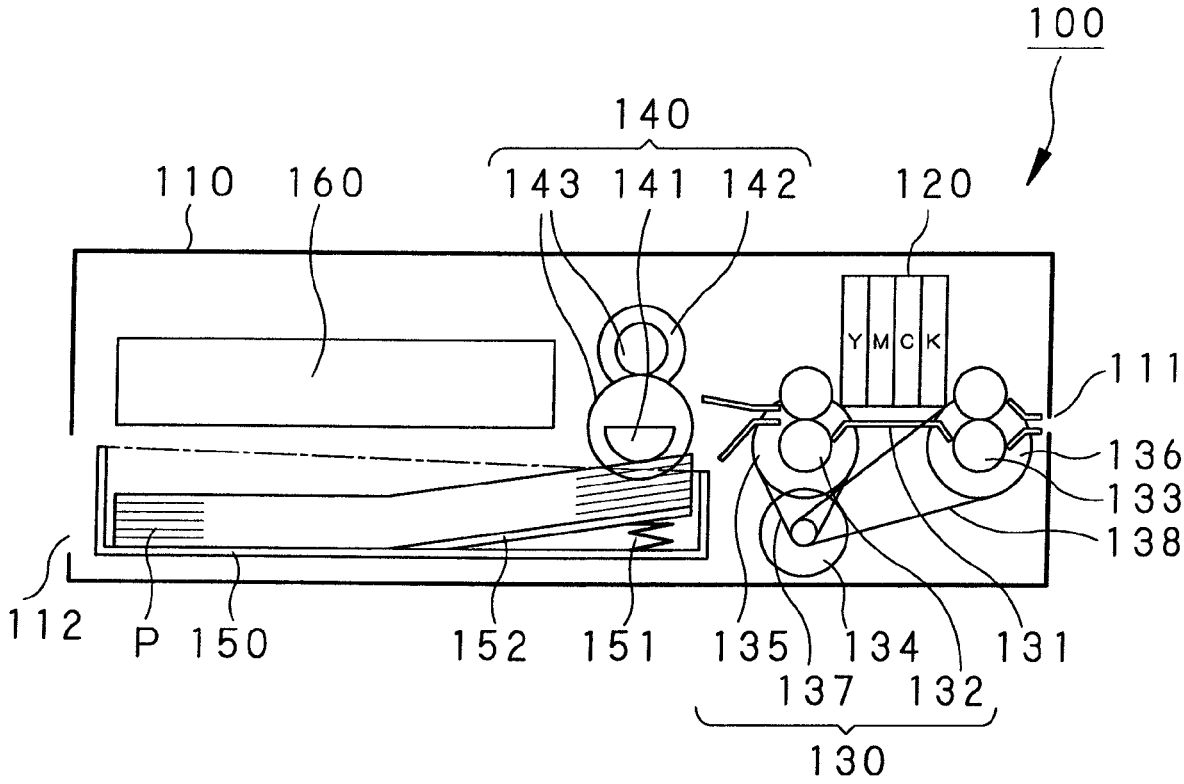
FIG. 2 is a side view of the ink jet printer.

Explanation will now be given below with reference to the attached drawings in connection with the embodiments of the present invention. This embodiment is shown in FIGS. 1 and 2. FIGS. 1 and 2 are an ink jet printer 100 which is a liquid discharge apparatus using a line head 120 serving as a liquid discharge head.

This ink jet printer 100 includes a heat element which will be described later as a drive element which discharges droplet of ink which is liquid. The ink jet printer 100 comprises the line head 120 having recording range of substantially width dimensions of paper P and having modulation function of the so-called PNM (Pulse Number Modulation) system adapted for carrying out modulation of diameter and density of dot by the number of droplets of ink. Here, for the sake of explanation, the number of droplets hit with respect to one dot is assumed to be 8 at the maximum per one color.

The ink jet printer 100 has the configuration in which the line head 120, a paper supply unit 130, a paper feed unit 140, a paper tray 150 and an electric circuit unit 160, etc. are arranged within a casing 110.

The casing 110 is formed so as to take rectangular parallelepiped shape, wherein a paper eject pocket 111 for paper P is provided at one end side surface and a tray exit/entrance 112 of the paper tray 150 is provided at the other end side. The line head 120 comprises head portions for four colors of CMYK (Cyan, Magenta, Yellow, Black), and is disposed at the upper end portion of the paper eject pocket 111 side within the casing 110 so that the ink discharge unit which discharges ink droplet is directed to the lower side. As described later, this line head 120 is caused to be of the configuration in which ink discharge means in a form elongated in width direction of paper P formed every respective colors, four ink discharge means in this case are arranged in feed direction of paper P.

The paper supply unit 130 comprises, as shown in FIG. 2, a paper supply guide 131, paper supply rollers 132, 133, a paper supply motor 134, pulleys 135, 136 and belts 137, 138, and is disposed at the lower end portion of the paper eject pocket 111 side within the casing 110. The paper supply guide 131 is formed so as to take flat plate shape, and is disposed at the lower portion of the line head 120 in the state where a predetermined spacing is provided. The respective paper supply rollers 132, 133 are constituted by a pair of rollers which are in contact with each other, and are disposed at both sides of the paper feed guide 131, i.e., the tray exit/entrance 112 side and the paper eject pocket 111 side. The paper supply motor 134 is disposed at the lower portion of the paper supply guide 131, and is connected to the respective paper supply rollers 132, 133 through the pulleys 135, 136 and the belts 137, 138.

The paper feed unit 140 comprises, as shown in FIG. 2, a paper feed roller 141, a paper feed motor 142, and a gear 143, and is disposed at the tray exit/entrance 112 side with respect to the paper supply unit 130. The paper feed roller 141 is formed so as to take substantially semi-cylindrical shape, and is disposed in the state close to the paper supply roller 132 of the tray exit/entrance 112 side. The paper feed motor 142 is disposed above the paper feed roller 141, and is connected to the paper feed roller 141 through the gear 143.

The paper tray 150 is formed so as to take box shape such that plural papers P of, e.g. A4 size can be accommodated in a piled manner, wherein a paper support 152 held by a spring 151 is provided at one end surface of the bottom surface. The paper tray 150 is disposed in a manner extending from the lower portion of the paper feed unit 140 toward the tray exit/entrance 112. The electric circuit unit 160 is a portion for driving respective components, and is disposed above the paper tray 150.

In such a configuration, its operation example will be explained.

User draws the paper tray 150 from the tray exit/entrance 112 to accommodate a predetermined number of papers P into the paper tray 150 to thrust it thereinto. Thus, the paper support 152 raises one end portion of paper P by action of the spring 151 to press it onto the paper feed roller 141. When print start signal is given, the paper feed roller 141 is rotated by drive of the paper feed motor 142 to feed one paper P from the paper tray 150 to the paper feed roller 132. Subsequently, the respective paper feed rollers 132, 133 are rotated by drive of the paper feed motor 134. As a result, the paper feed roller 132 sends out the paper P which has been sent out to the paper feed guide 131. Thus, the line head 120 becomes operative at a predetermined timing in accordance with data to be printed to discharge droplet of ink from the ink discharge unit to impact it onto the paper P to record character and/or image consisting of dots, etc. The paper feed roller 133 ejects, from the paper eject pocket 111, the paper P which has been sent out.

Then, the internal configuration of the electric circuit unit 160 and the block configuration of the peripheral portion thereof will be explained by using FIG. 3.

The electric circuit unit 160 comprises a printer side data processing section 161, a head controller 162, a head position/paper feed controller 163, and a system controller 164.

The printer side data processing section 161 receives, e.g., print data $D_{PR}$ which has been caused to undergo data transfer from computer device to take out, from this print data $D_{PR}$, information necessary for print, and to develop compressed image data to restore such image data into respective data of CMYK. Further, CMYK respective multi-value data are caused to undergo sequencing in drive order of the line head 120 to generate recording data (head drive data $D_{HD}$).

The head controller 162 receives recording data to control ink droplet discharge operation of the line head 120. Here, this ink droplet discharge operation will be briefly explained. When input of recording data is provided from the printer side data processing section 161, the head controller 162 generates head drive information at respective discharge timings on the basis of discharge timing table from that recording data, kind of colors (CMYK) and position of pixels to drive respective ink discharge units. In this instance, discharge timing table of recording data where shift of dot impact position becomes stripe so that there results conspicuous dot diameter is set so that discharge timings are shifted every one pixel of print direction serving as head relative movement direction.

Figure 4:
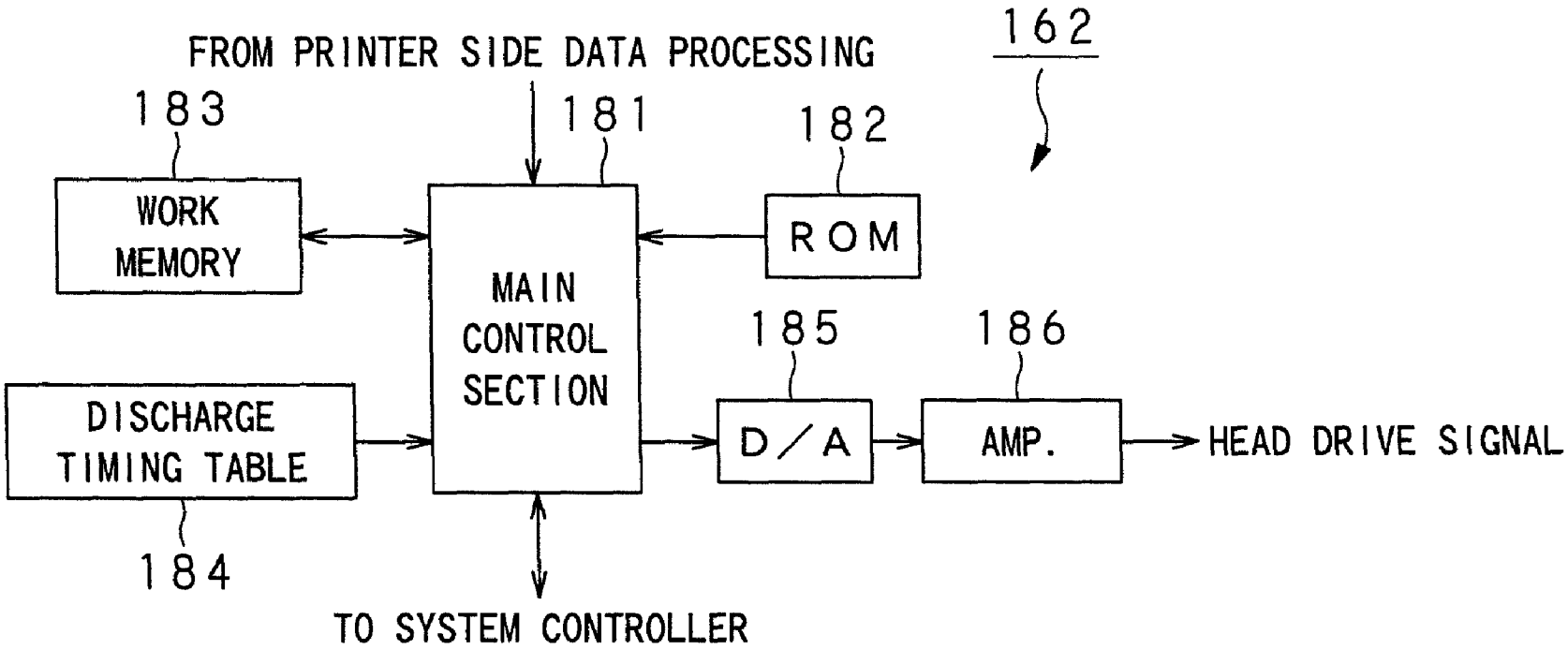
FIG. 4 is a block diagram showing the detailed configuration of head controller.

This head controller 162 comprises, as shown in FIG. 4, a main control section 181 comprised of microprocessor, etc. and serving to control the entirety of the head controller 162, a ROM 182 in which image formation program based on the image formation method according to the present invention that the main control section 181 executes is stored, a work memory 183 comprised of RAM, etc. and used for predetermined operations and/or temporary data storage, etc. by the main control section 181, a discharge timing table 184, a D/A converter 185 for converting drive data that the main control section 181 executes image formation program stored in the ROM and further generates with reference to the discharge timing table 184 into analog signal, and an amplifier 186 which amplifies analog output of the D/A converter 185.

The head position/paper feed controller 163 controls position of the line head 120 and/or paper feed of recording paper P.

The system controller 164 controls the printer side data processing section 161, the head controller 162 and the head position/paper feed controller 163.

Then, explanation will be given by using FIGS. 5 to 9 in connection with the detail of the line head 120.

Figure 9:
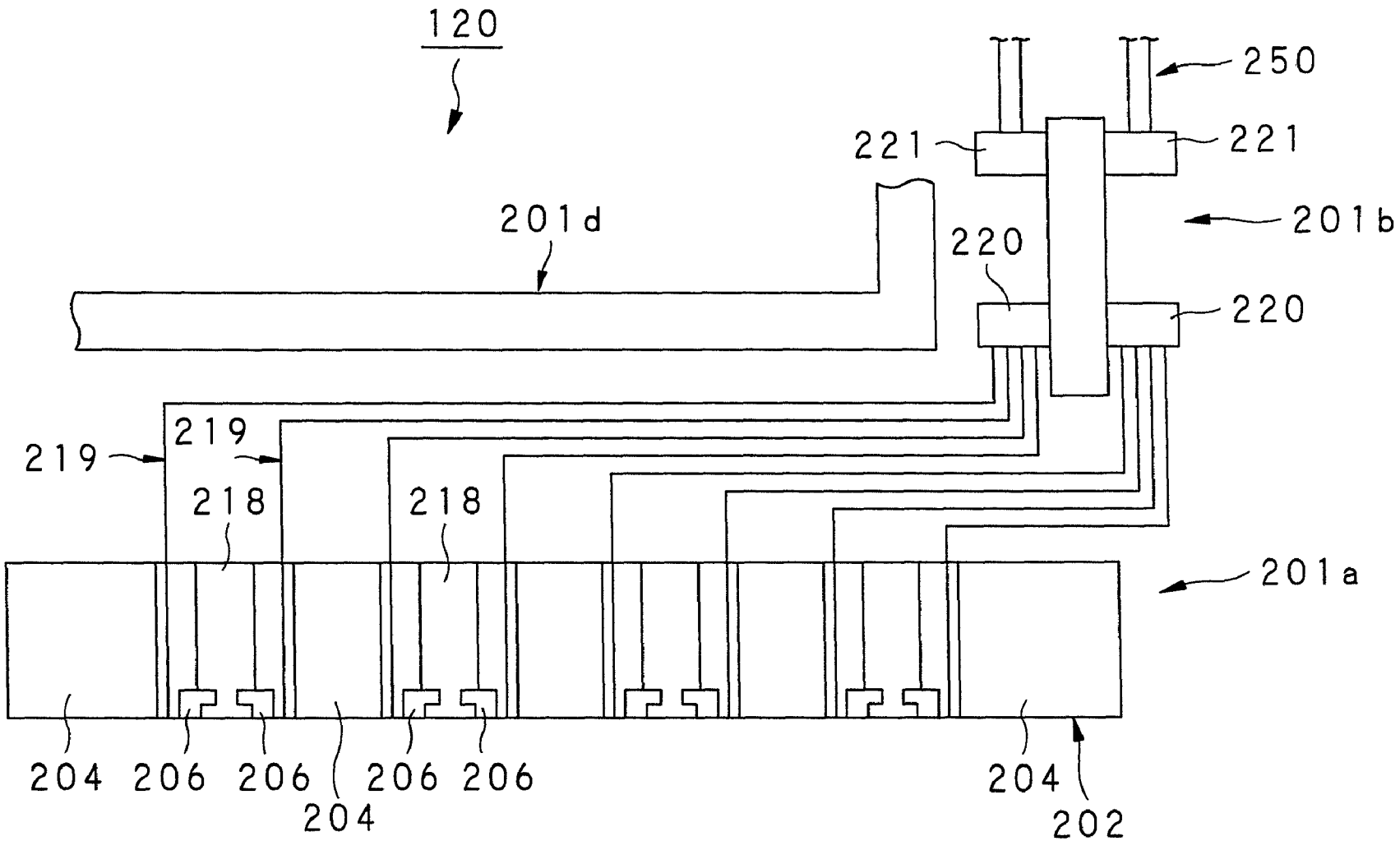
FIG. 9 is a cross sectional view showing line head.

The line head 120 comprises a head chip module 201*a* and a junction base (board) 201*b* which are caused to be of the structure shown in FIG. 9. In this case, explanation will be first given below in connection with the head chip module 201*a*. Additionally, FIG. 5 is an exploded perspective view of the head chip module 201*a*.

Figure 5:
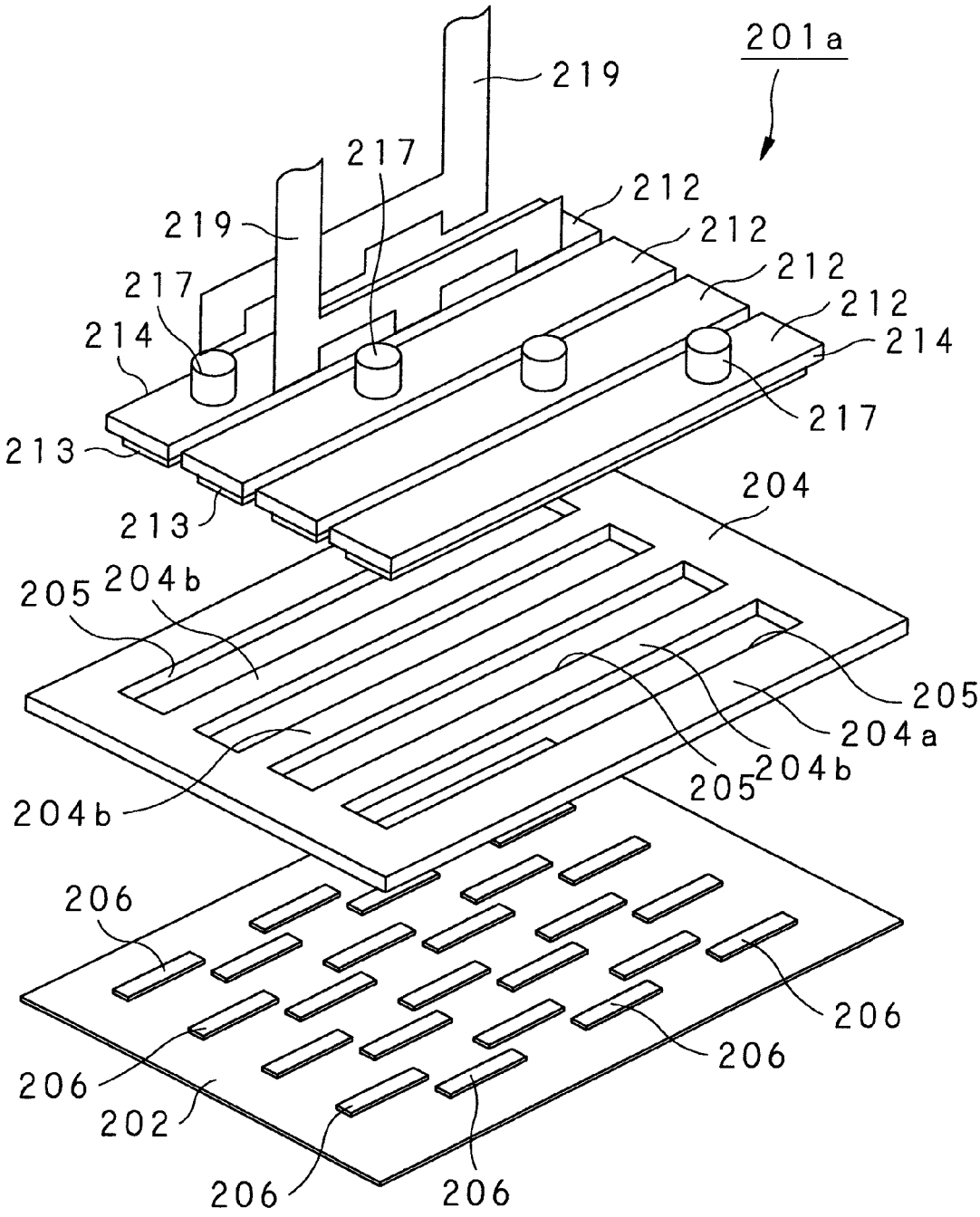
FIG. 5 is an exploded perspective view of head chip module provided at line head.
Figure 6:
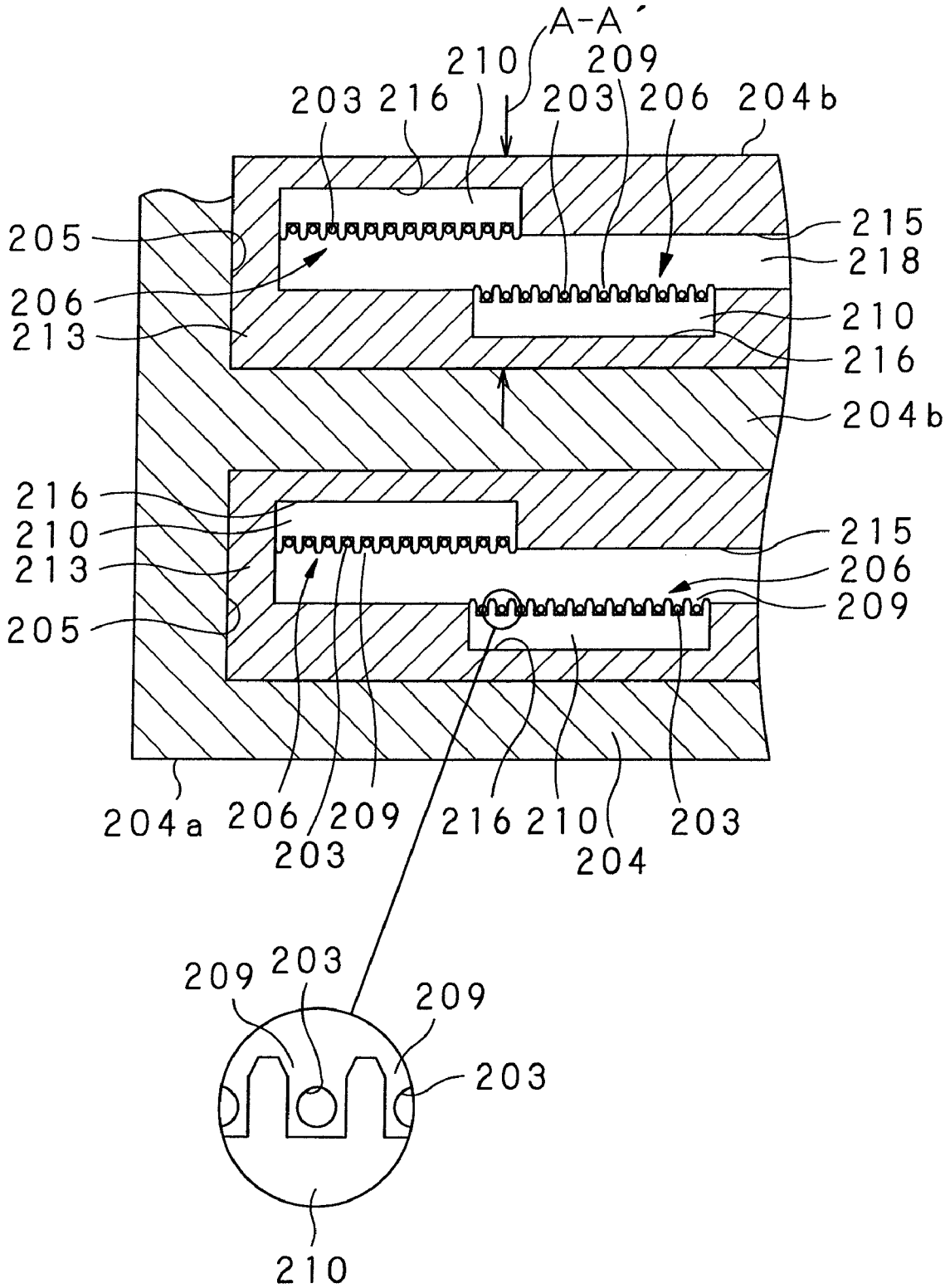
FIG. 6 is an outline plane view showing, in an enlarged manner, essential part of head chip module provided at line head.

The head chip module 201*a* comprises, as shown in FIGS. 5 and 6, a nozzle formation member 202 formed so as to take substantially flat plate shape which constitutes ink discharge surface. At the nozzle formation member 202, a large number of ink discharge nozzles 203 are formed. Several hundreds number of ink discharge nozzles are respectively formed in alignment at positions where head chips which will be described later are arranged. These nozzle formation members 202 are formed in sheet shape by various electrocasting technologies with, e.g., nickel or material including nickel being as material so that thickness is equal to about 15 μm~20 μm. Diameters of the respective ink discharge nozzles 203 are caused to be, e.g., about 20 μm. The nozzle formation member 202 where the ink discharge nozzles 203 are formed in this way are stuck (attached) to a head frame 204.

The head frame 204 is adapted so that, e.g., three pier members 204*b* are bridged at equal interval between short sides of an outer frame 204*a* caused to have rectangular shape, and the outer frame 204*a* and the pier members 204*b* are integrally formed. Namely, at the head frame 204, four rectangular spaces 205 where the outer frame 204*a* is separated by the pier members 204*b* are constituted in parallel. Here, in the case where the head chip module 201*a* is used for the line head 120 which simultaneously prints one line in width direction of paper P with respect to the paper P, length of this space 205 is caused to be substantially equal to length of one line printed at the same time. For example, in the case where the head chip module 201*a* is used for the line head 120 which carries out printing in carrying direction of paper P of A4 size, length of this space 205 is caused to be length corresponding to lateral width of paper of A4 size, i.e., about 21 cm.

This head frame 204 may be by, e.g., silicon nitride, or may be formed by ceramic material such as alumina, mullite, alumi nitride or silicon carbon, etc. In addition, the head frame 204 may be also formed by glass material such as quartz ($SiO_2$), etc. or metallic material such as invarsteel, etc. It is to be noted that the invarsteel is alloy invented by Guillanume (France) in 1896.

The head frame 204 has thickness of, e.g., about 5 mm, and has rigidity sufficient to support the nozzle formation member 202. The head frame 204 and the nozzle formation member 202 are stuck by, e.g., heat hardening type sheet-shaped adhesive agent.

Figure 7:
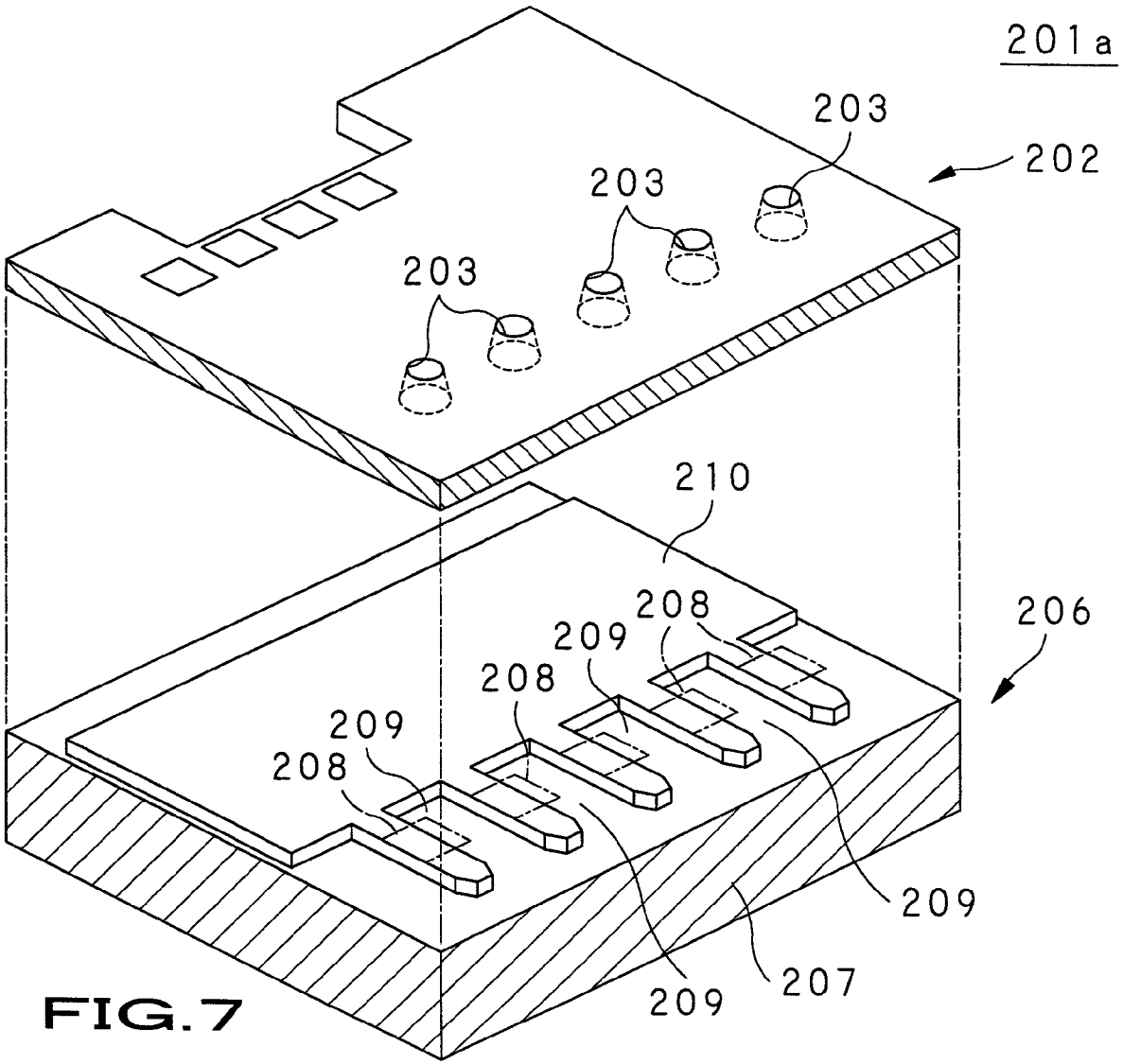
FIG. 7 is an exploded perspective view showing, in an enlarged manner, essential part of head chip module provided at line head.

At the nozzle formation member 202, a large number of head chips 206 are disposed. As shown in FIG. 7, at the head chip 206, plural heat resistors 208 are formed on the principal surface of a substrate (base) 207 formed by, e.g., silicon by various thin film formation technologies. This heat resistor 208 is adapted so that, e.g., one side is caused to have regular rectangular shape of about 18 μm.

On the substrate 207, a barrier layer 210 which constitutes the wall portion of an ink pressure application chamber 209 is laminated at the surface where the heat resistor 208 is formed. The barrier layer 210 is formed by, e.g., dry film resist having light hardening property, and is formed as the result of the fact that such material is laminated on the entire surface of the substrate 207 and unnecessary portions are then removed by photolitho process. This barrier layer 210 is caused to have thickness of about 12 μm, and width of each ink pressure application chamber 209 is caused to be about 25 μm.

Here, when the case where the head chip module 201*a* according to this example is used in the state mounted on the line head having resolution of 600 dpi which prints paper of A4 size in longitudinal direction which is carrying direction of paper P is assumed, the number of ink discharge nozzles 203 formed at the nozzle formation member 202 every regions of respective spaces 205 of the head frame 204 is caused to be about 500. When the number of head chips 206 disposed at the nozzle formation member 202 within these areas is caused to be, e.g., 16, the number of ink discharge nozzles 203 corresponding to one head chip 206 is about 310. It is to be noted that the number of respective portions and/or size thereof are indicated in an exaggerated or omitted manner for convenience of explanation in FIGS. 5 and 6.

At the head chip module 201*a*, flow path plates 212 are attached at respective spaces 205 formed at the head frame 204 with respect to the nozzle formation member 202 where the head chips 206 are disposed.

Four flow path plates 212 are provided in correspondence with respective colors of inks. The flow path plate 212 is formed by material having sufficient rigidity and ink resistance characteristic. The flow path plate 212 is adapted so that a chamber portion 213 fitted within the space 205 of the head frame 204 and a flange portion 214 formed at one end portion of this chamber portion 213 in a projected manner are integrally formed.

Figure 8:
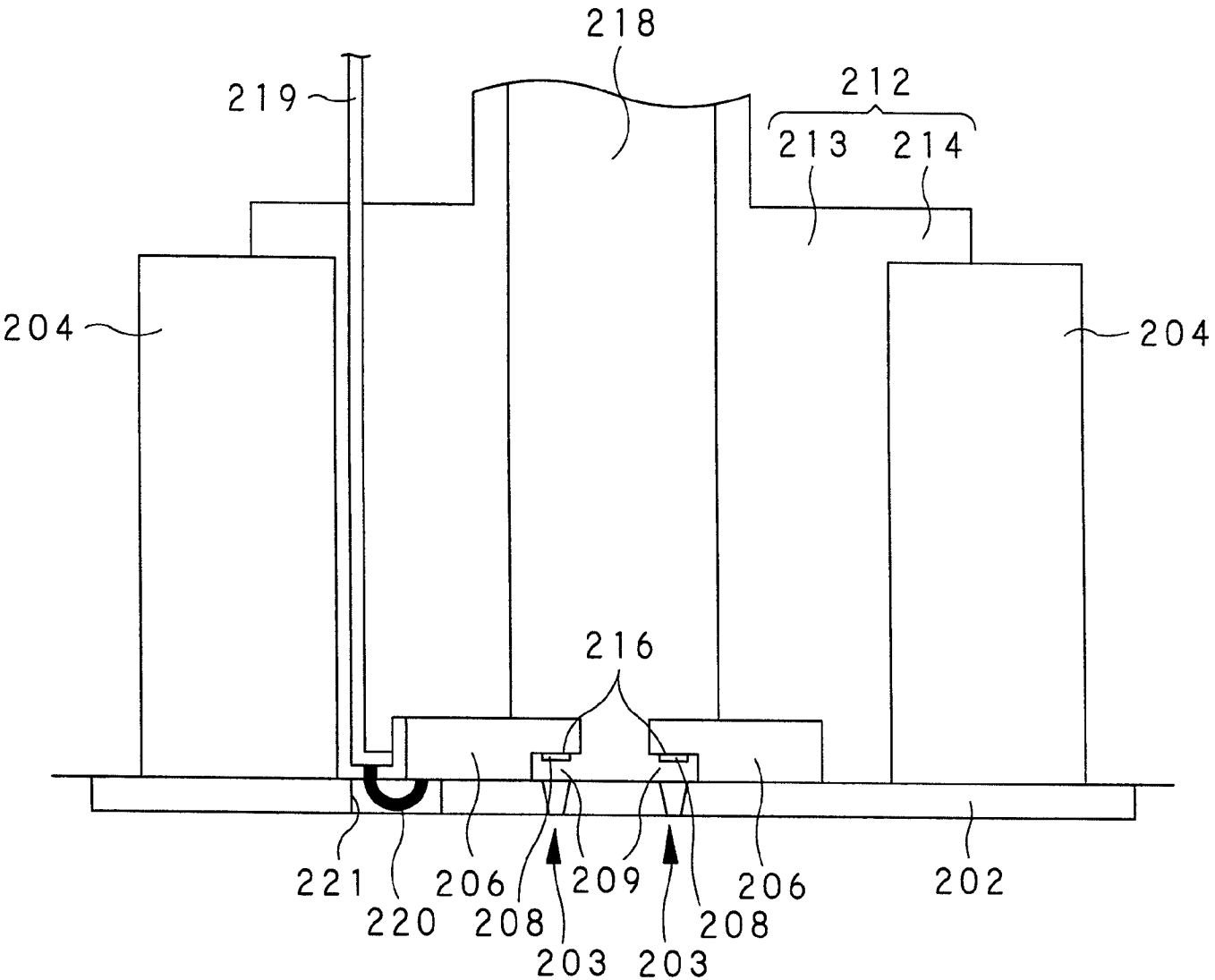
FIG. 8 is a cross sectional view showing, in an enlarged manner, essential part of head chip module provided at line head.

The cross section along A-A' line in FIG. 6 is shown in FIG. 8.

The head chip module 201*a* will be further explained below by using FIGS. 6 and 8. The flange portion 214 is formed so as to have shape greater than plane shape of the space 205 of the head frame 204. The chamber portion 213 includes a space 215 shown in FIG. 6 opened to the end surface of the side opposite to the side where the flange portion 214 is formed. At the wall portion which limits both sides of this space 215, there are formed cut recessed portions 216 shown in FIGS. 6 and 8 for the purpose of positioning the head chip 206 in a manner to communicate with the spaces 215. At the flange portion 214, ink supply tubes 217 are projected from the surface of the side opposite to the surface where the chamber portion 213 is extended. These ink supply tubes 217 communicate with the spaces 215.

The flow path plate 212 is connected (bonded) to the head frame 204 in the state where the chamber portion 213 is fitted into space 205 of the head frame 204 and the flange portion 214 is caused to be in contact with the pier member 204*b* of the head frame 204. The head chips 206 disposed at the nozzle formation member 202 are positioned within the cut recessed portion 216 formed at the chamber portion 213 of the flow path plate 212, and are bonded to the chamber portion 213. Thus, closed space surrounded by the chamber portion 213 of the flow path plate 212 and the nozzle formation member 202 is formed. This closed space is caused to communicate with the external only through the ink supply tube 217 and the ink discharge nozzle 203. At this closed space, the ink flow path 218 is formed between rows of the head chips 206 arranged in a zigzag manner while adjacent ones overlap with each other, and there results the state where respective ink pressure application chambers 209 shown in FIGS. 6 to 8 are caused to communicate by this ink flow path 218.

The ink supply tubes 217 provided at the flow path plate 212 are respectively connected to ink tanks (not shown) in which inks of colors different from each other are stored. Thus, inks are filled within the respective ink flow paths 218 and the ink pressure application chamber 209.

At the head chip module 201*a* constituted as described above, in carrying out print with respect to paper, current pulse is delivered to the heat resistor 208 selected by command from head controller 162 (see FIG. 3) for a short time period of, e.g., about 1~3 micro seconds, and this heat resistor 208 is rapidly heated. Thus, ink air bubbles are generated at the portion in contact with this heat resistor 208. By swelling and contraction of the ink air bubbles, ink droplets are discharged from the ink discharge nozzle 203, and are attached to the paper. At the ink pressure application chamber 209 from which ink droplets have been discharged, inks are filled up through the ink flow path 218. In a manner as stated above, print with respect to paper is carried out.

It is to be noted that while heat element is used as drive element which discharges ink from the ink discharge portion in the line head 120, piezo-electric element represented by piezo element may be used to discharge ink from the ink discharge portion.

In the case where piezo-electric element is used, a line head 120' which will be explained below may be used. This example will be explained with reference to FIGS. 10 to 12.

Figure 10:
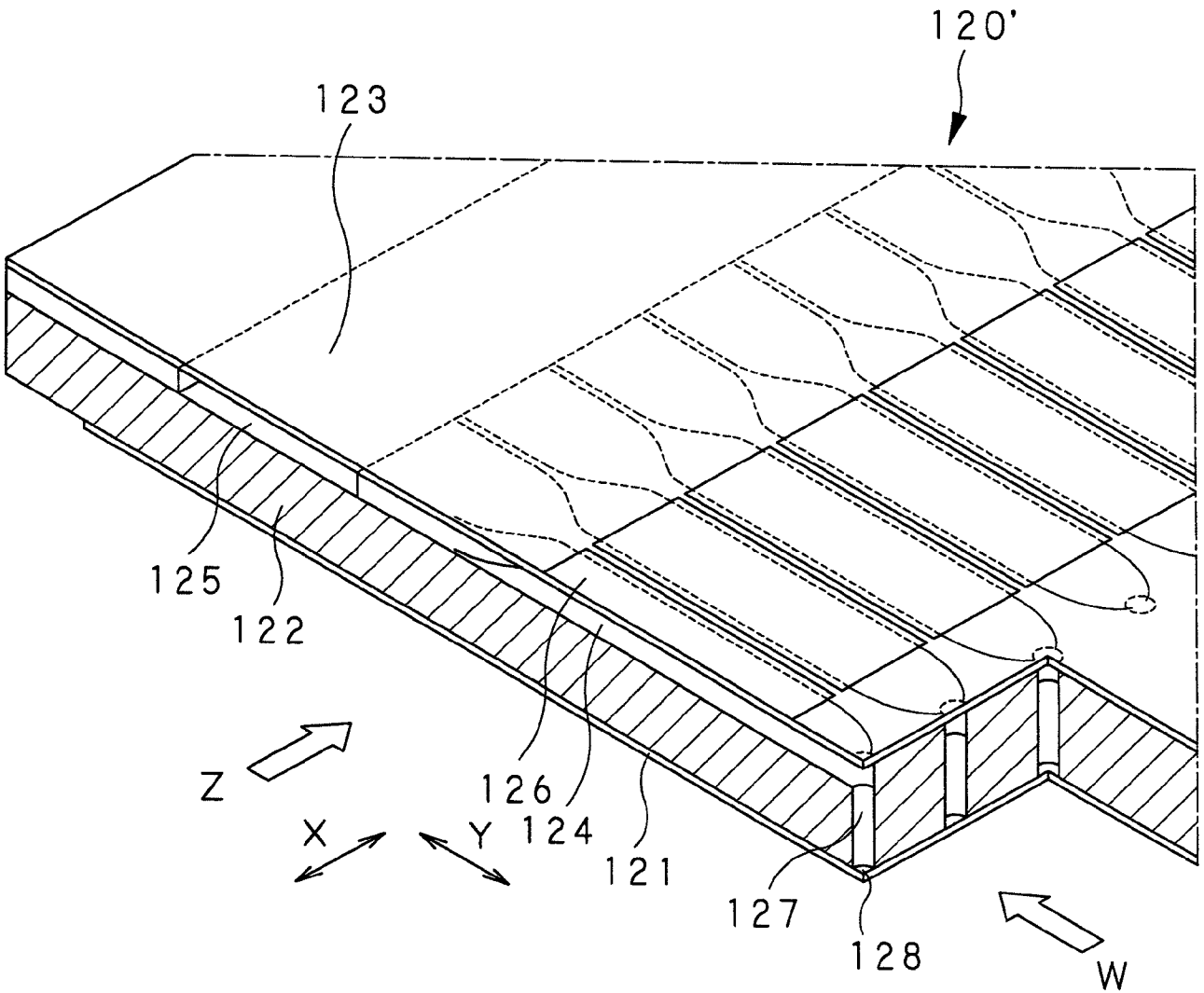
FIG. 10 is a perspective view showing another practical example of line head.
Figure 11:
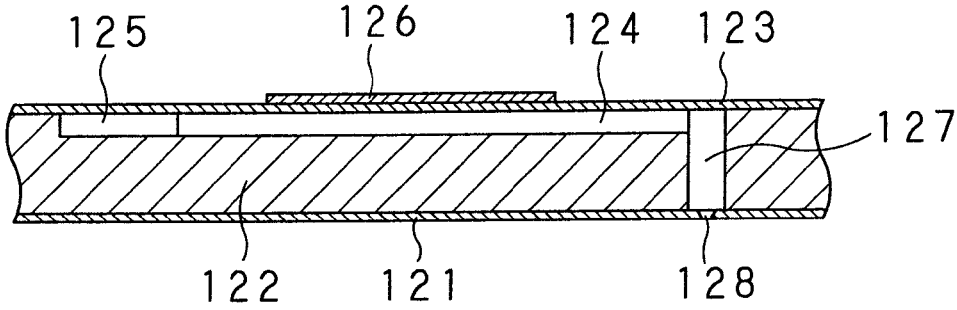
FIG. 11 is a cross sectional view showing one structural example of line head.
Figure 12:
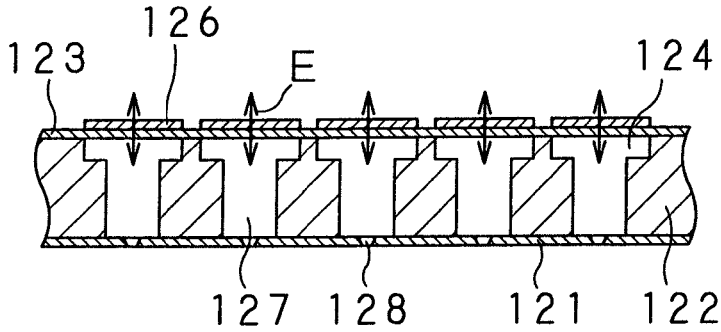
FIG. 12 is a cross sectional view showing one structural example of line head.

FIG. 10 shows the perspective cross sectional structure of the line head 120', FIG. 11 shows cross sectional structure when the line head 120' in FIG. 10 is viewed from the direction indicated by arrow Z in FIG. 10, and FIG. 12 shows cross sectional structure when the line head 120' in FIG. 10 is viewed from the direction indicated by arrow W in FIG. 10. As shown in these figures, the line head 120' is caused to be of the configuration comprising a thin nozzle plate 121, a flow path plate 122 laminated on the nozzle plate 121, and a vibration plate 123 laminated on the flow path plate 122. These respective plates are stuck with each other by adhesive agent (not shown).

At the vibration plate 123 side of the flow path plate 122, recessed portions are selectively formed. By these recessed portions and the vibration plate 123, plural ink chambers 124 and a common flow path 125 communicating with these ink chambers are constituted. The communicating portion of communication between the common flow path 125 and the respective ink chambers 124 is caused to be narrow path, and there is employed a structure such that the flow path width becomes broader toward the direction of the respective ink chambers 124 from here. On the vibration plate 123 immediately above the respective ink chambers 124, piezo-electric elements 126 comprised of, e.g., piezo element, etc. are respectively fixed. On the respective piezo-electric elements 126, electrodes (not shown) are respectively laminated and disposed. By applying drive signal from the head controller 162 to these electrodes, the respective piezo-electric elements, in its turn, the vibration plate 123 is bent in the direction indicated by arrow E in FIG. 12 so that capacity of the ink chamber 124 is increased (swelled) or is decreased (contracted).

The portion of the side opposite to the side communicating with the common flow path 125 at the respective ink chambers 124 has the structure that the flow path width gradually becomes narrow, wherein a flow path hole 127 is provided at the flow path plate 122 of the terminating portion thereof. This flow path hole 127 communicates with very small nozzles 128 formed at the nozzle plate 121 of the lowermost layer, and ink droplets are discharged from these nozzles 128. At the line head 120, as shown in FIG. 10, plural nozzles 128 are formed in line at equal interval along the direction X perpendicular to paper feed direction Y of recording paper P.

Figure 3:
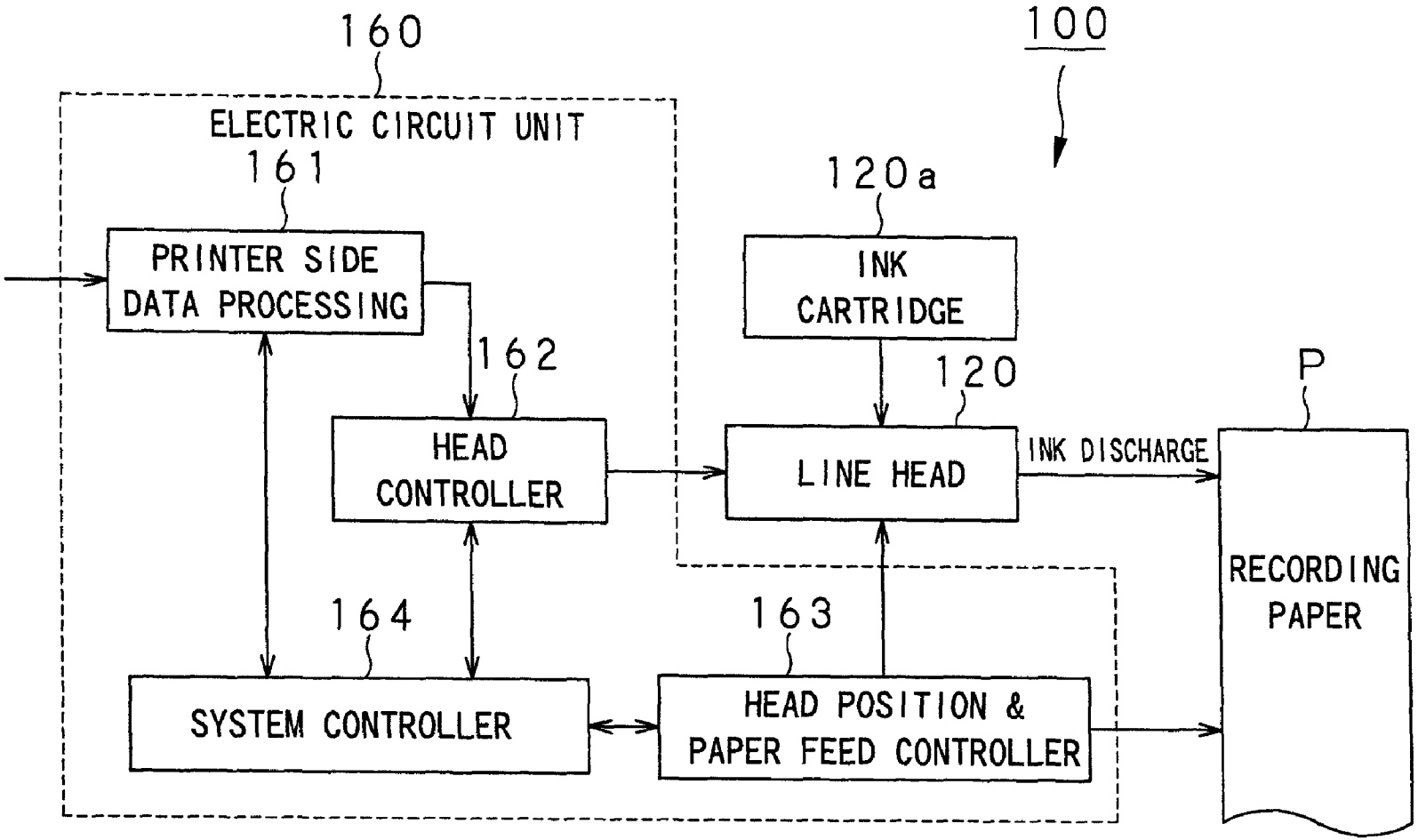
FIG. 3 is a block diagram of electric circuit unit constituting the ink jet printer.

The common flow path 125 communicates with ink cartridge 120*a* (see FIG. 3). Inks are supplied from this ink cartridge 120*a* to the respective ink chambers 124 via the common flow path 125. While this supply of inks can be carried out by making use of, e.g., the capillary tube phenomenon, a predetermined pressure application mechanism may be provided at the ink cartridge 120*a* in addition to the above to apply pressure to thereby carry out such supply.

In the ink jet printer 100 of the configuration as previously described, the feature of the present invention will be further intelligibly explained.

Here, explanation will be given in connection with the case where inks of Magenta (M), Yellow (Y) and Black (K) are not used, and only Cyan (C) ink is used.

Figure 13:
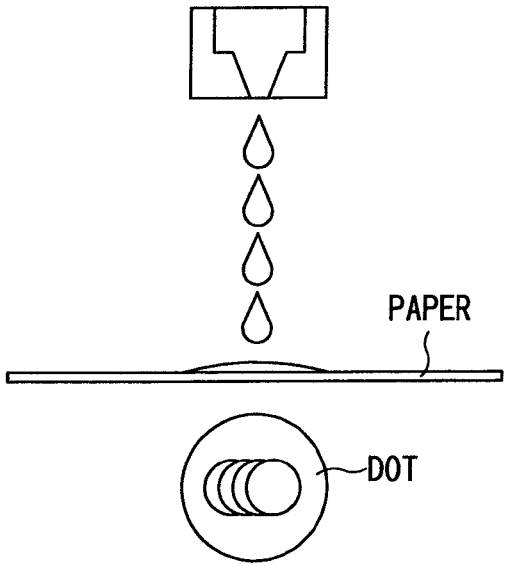
FIG. 13 is a view for explaining PNM system.
Figure 14:
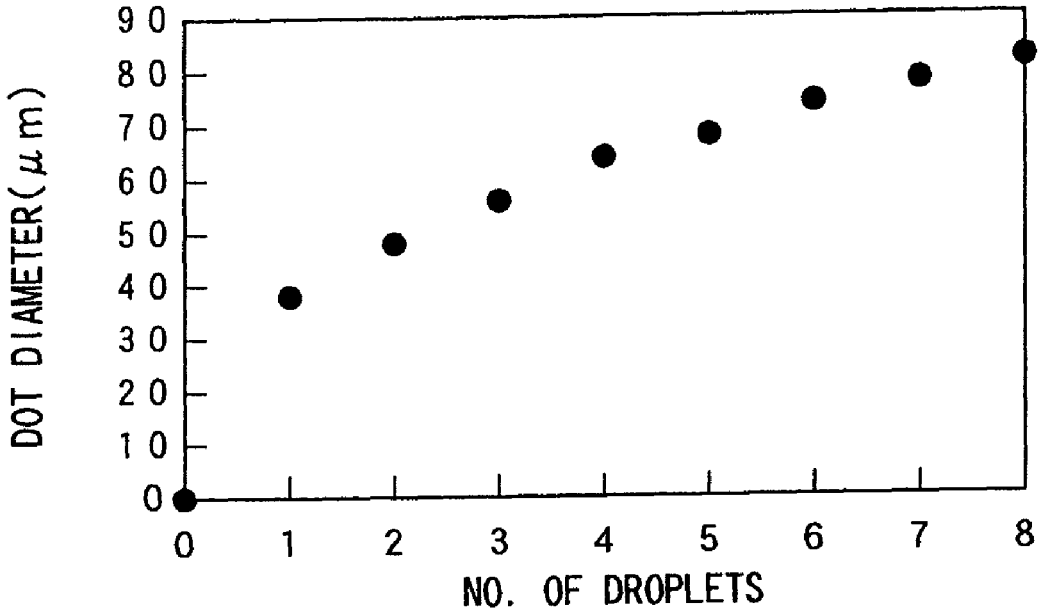
FIG. 14 is a characteristic diagram showing the relationship between the number of droplets and dot diameter.
Figure 15:
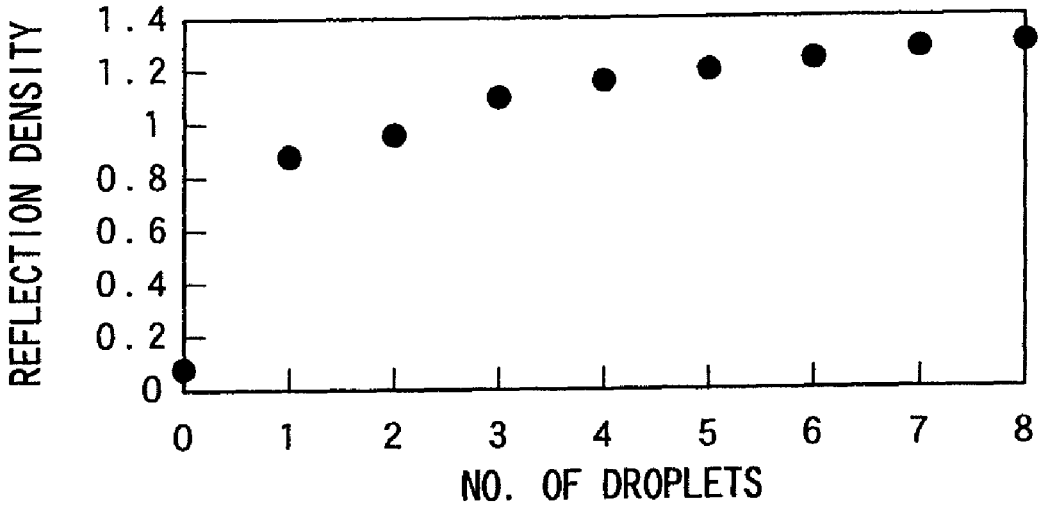
FIG. 15 is a characteristic diagram showing the relationship between the number of droplets and reflection density.

1 dot of Cyan is variable from 0 to 8 droplets as the number of droplets by the PNM system as described above. Thus, as shown in FIG. 13, it is possible to modulate size and density (reflection density) of dots by the number of droplets which are hit with respect to one pixel. Change of dot diameter with respect to change of the number of droplets is shown in FIG. 14. When the number of droplets is caused to be 1, dot diameter becomes equal to 40 μm or less. Further, when the number of droplets is increased in a manner of 2, 3, 4, 5, 6, 7 and 8 droplets, dot diameter is also gently increased in a manner of 49, 58, 62, 68, 73, 78 and 82 μm. Further, change of reflection density with respect to the number of droplets is shown in FIG. 15. Reflection density when the number of droplets is 0 is 0.07 which is reflection density of print paper. When the number of droplets is changed into 1, reflection density becomes equal to about 0.85. Further, when the number of droplets is increased in a manner of 2, 3, 4, 5, 6, 7 and 8 droplets, reflection density is also gently increased in a manner of 0.95, 1.08, 1.17, 1.20, 1.25, 1.28 and 1.30.

Figure 16:
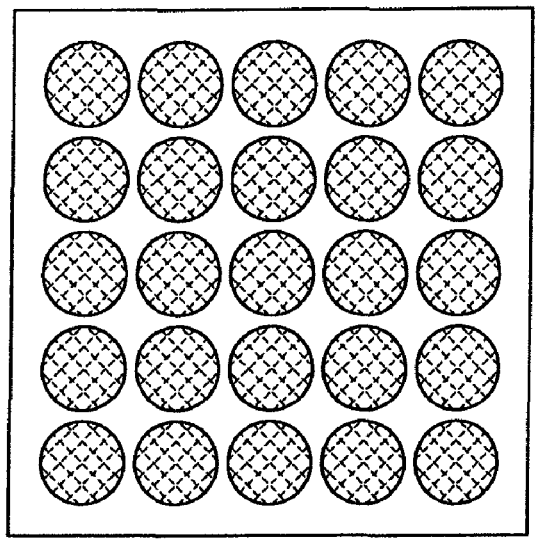
FIG. 16 is a view showing the result that solid plane print is carried out by dot of PNM 1 by head as primarily designed.

In the case where dot of such Cyan is printed by density of 600 dpi, if accuracy of the ink discharge unit and/or the state of the nozzle surface which is constituent part of the ink discharge unit are ones ideally primarily designed, when solid plane print is carried out by dot in which the number of droplets is, e.g., 1 by PNM by means of such ideal head, dots are to be uniformly hit onto print paper as shown in FIG. 16. Namely, there is no possibility that impact position of dot is shifted.

Figure 17:
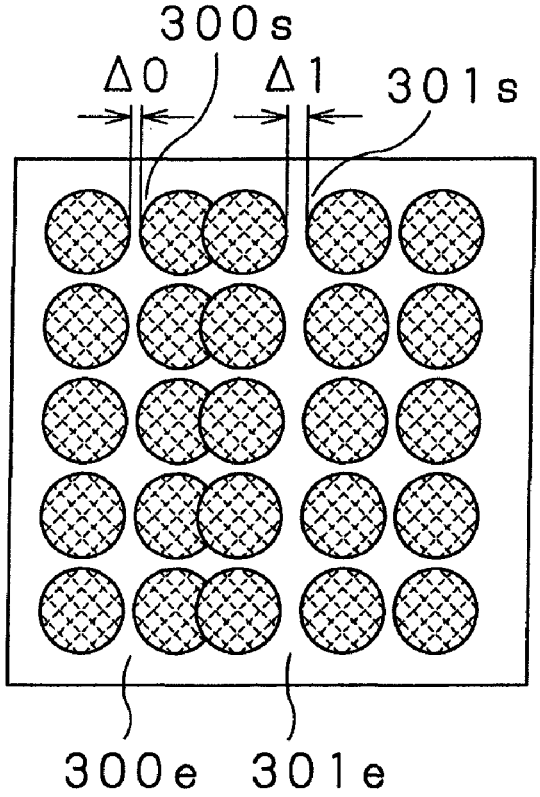
FIG. 17 is a view for explaining occurrence of stripe.

In practice, there are instances where the impact position may deviate (be shifted) from primary position by influence such as accuracy of the ink discharge unit and/or the state of nozzle surface which is constituent part of the ink discharge unit, etc. Some positional shifts take place at random every discharge operation. In this case, positional shift resulting from accuracy of the ink discharge unit, etc. is peculiar to respective ink discharge units. When printing is carried out by using the same nozzle, tendency of that positional shift exists from the beginning to the last. For this reason, particularly when impact position is shifted in the ink discharge unit arrangement direction, gaps $\mathbf{301}_s$~$\mathbf{301}_e$ by white ground where width ($\Delta_1$) has been broadened as compared to other gaps $\mathbf{300}_s$~$\mathbf{300}_e$ in longitudinal direction as shown in FIG. 17 ($\Delta_1 > \Delta_0$) take place as stripe.

In the case where dot diameter is sufficiently small as compared to resolution, i.e., in such cases that the number of droplets by PNM is 1, because the portion of white ground is many, such stripe is difficult to be conspicuous. However, in the case of dot diameter equivalent to pitch of pixel or slightly greater than that, i.e., in such cases that the number of droplets by PNM is 3 or 4, such stripe is divided into the portion of white stripe and the portion which is not the white stripe. As a result, such stripe becomes conspicuous.

Figure 18A:
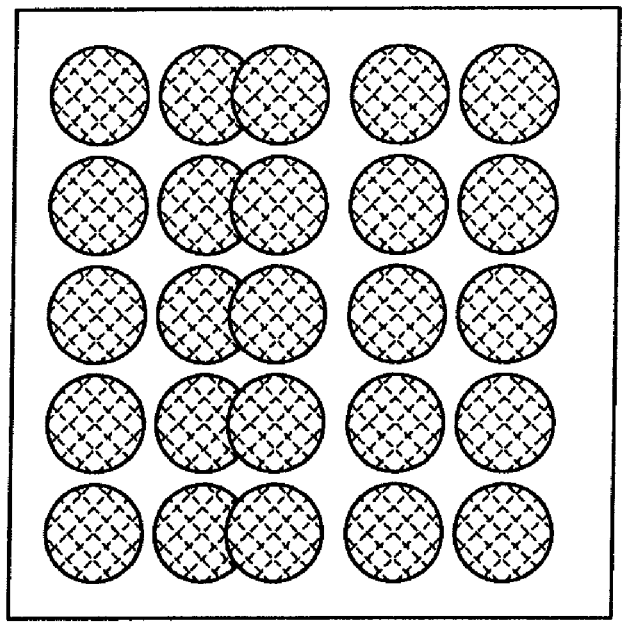
FIGS. 18A and 18B are views for explaining enlargement of stripe by surface tension of ink.
Figure 18A:
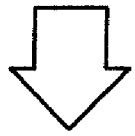
Figure 18B:
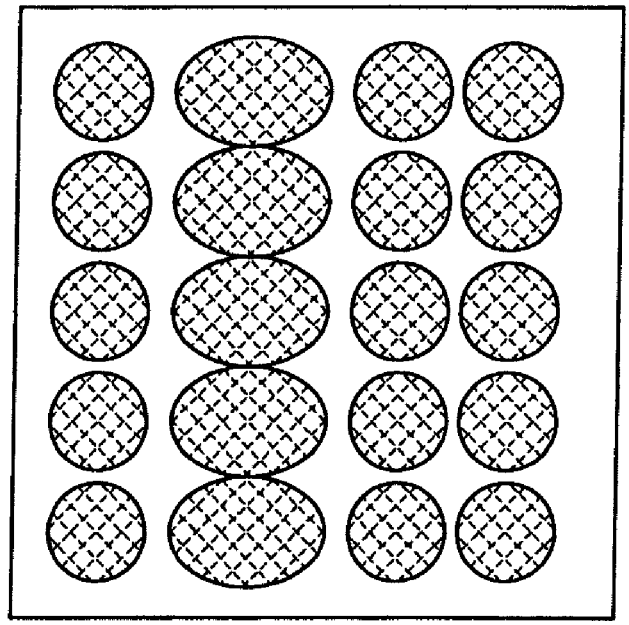
Figure 19:
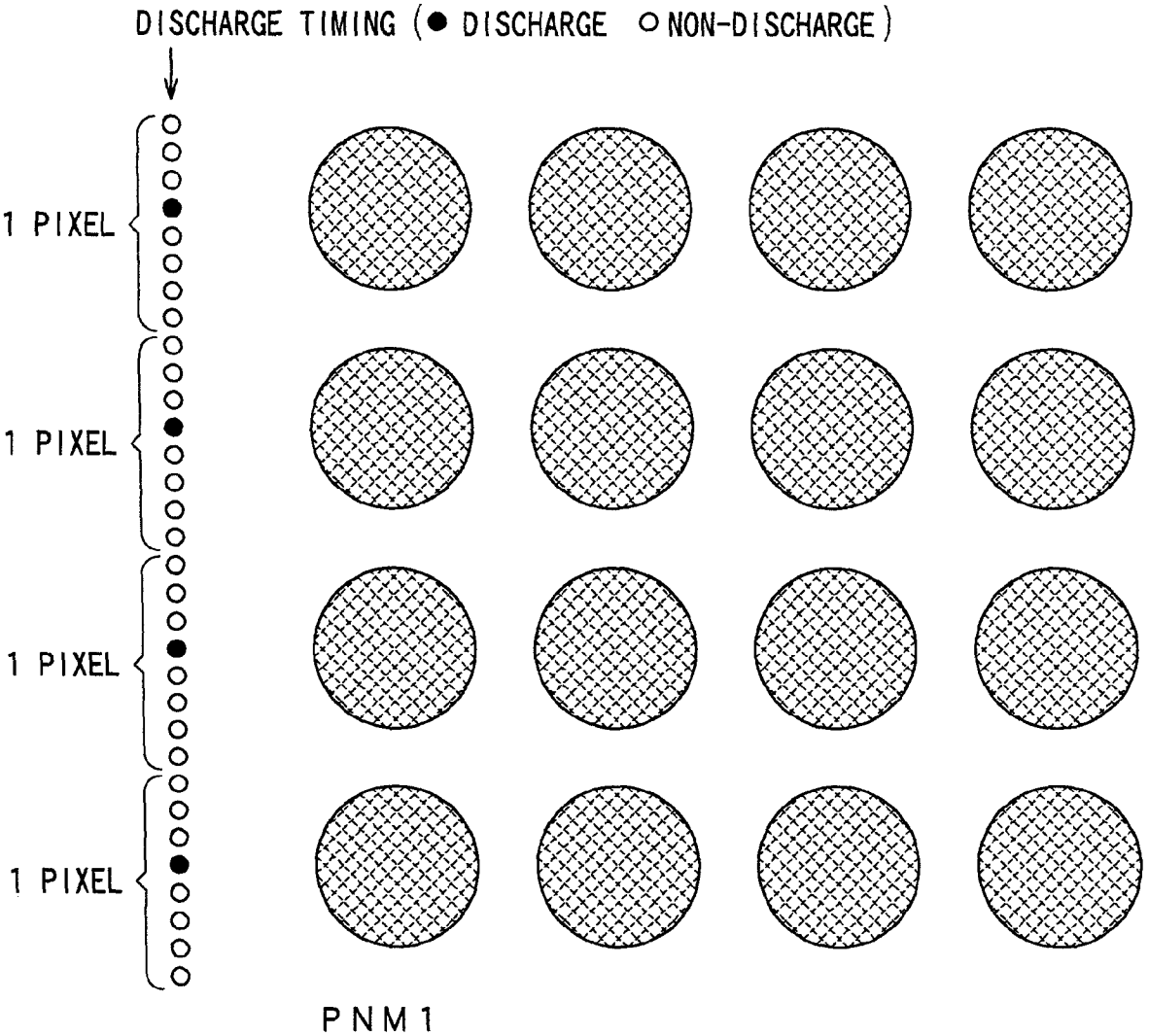
FIG. 19 is a view showing ink droplet discharge timing in the conventional PNM 1.
Figure 20:
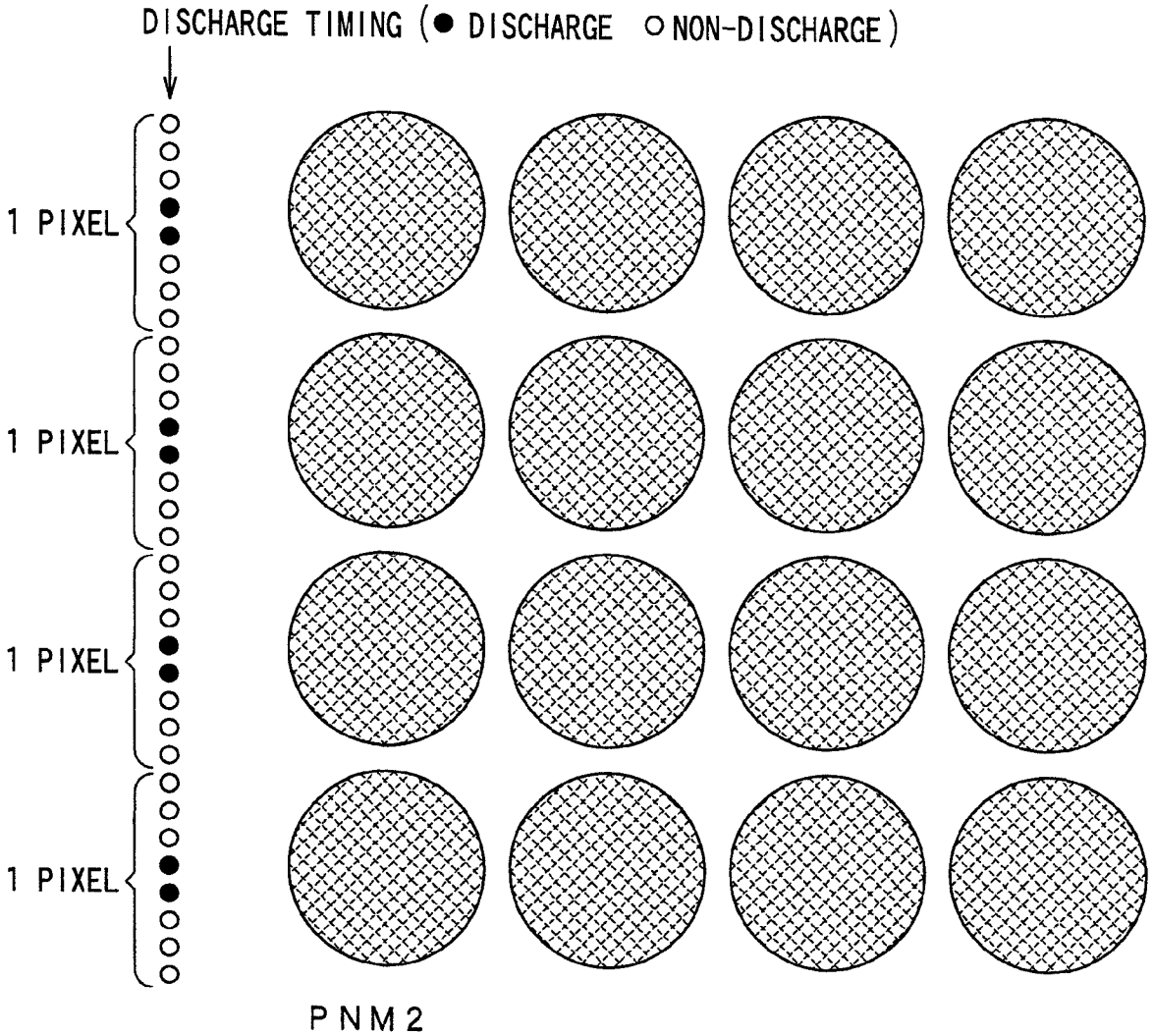
FIG. 20 is a view showing ink droplet discharge timing in the conventional PNM 2.
Figure 21:
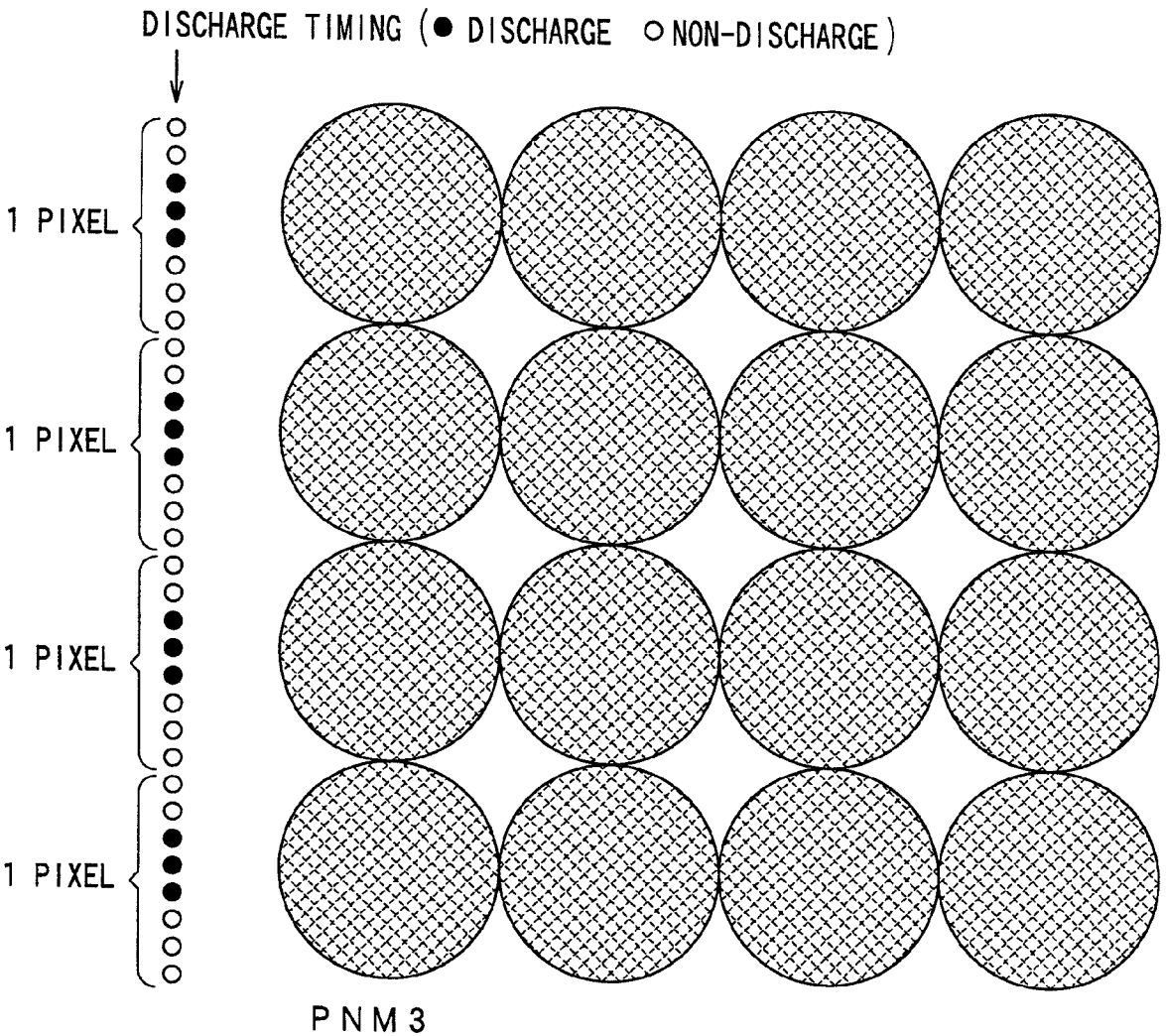
FIG. 21 is a view showing ink droplet discharge timing in the conventional PNM 3.
Figure 22:
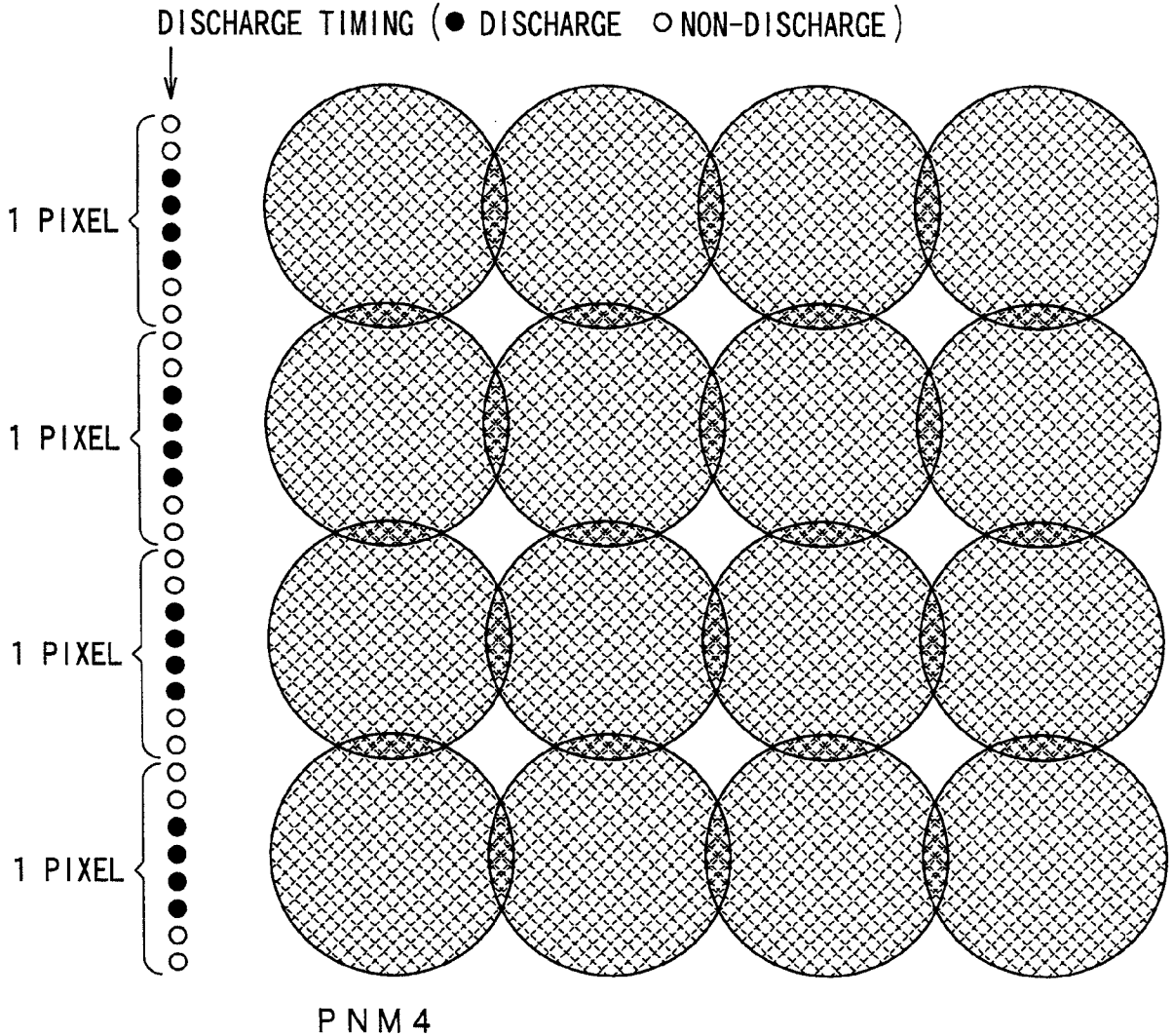
FIG. 22 is a view showing ink droplet discharge timing in the conventional PNM 4.
Figure 23:
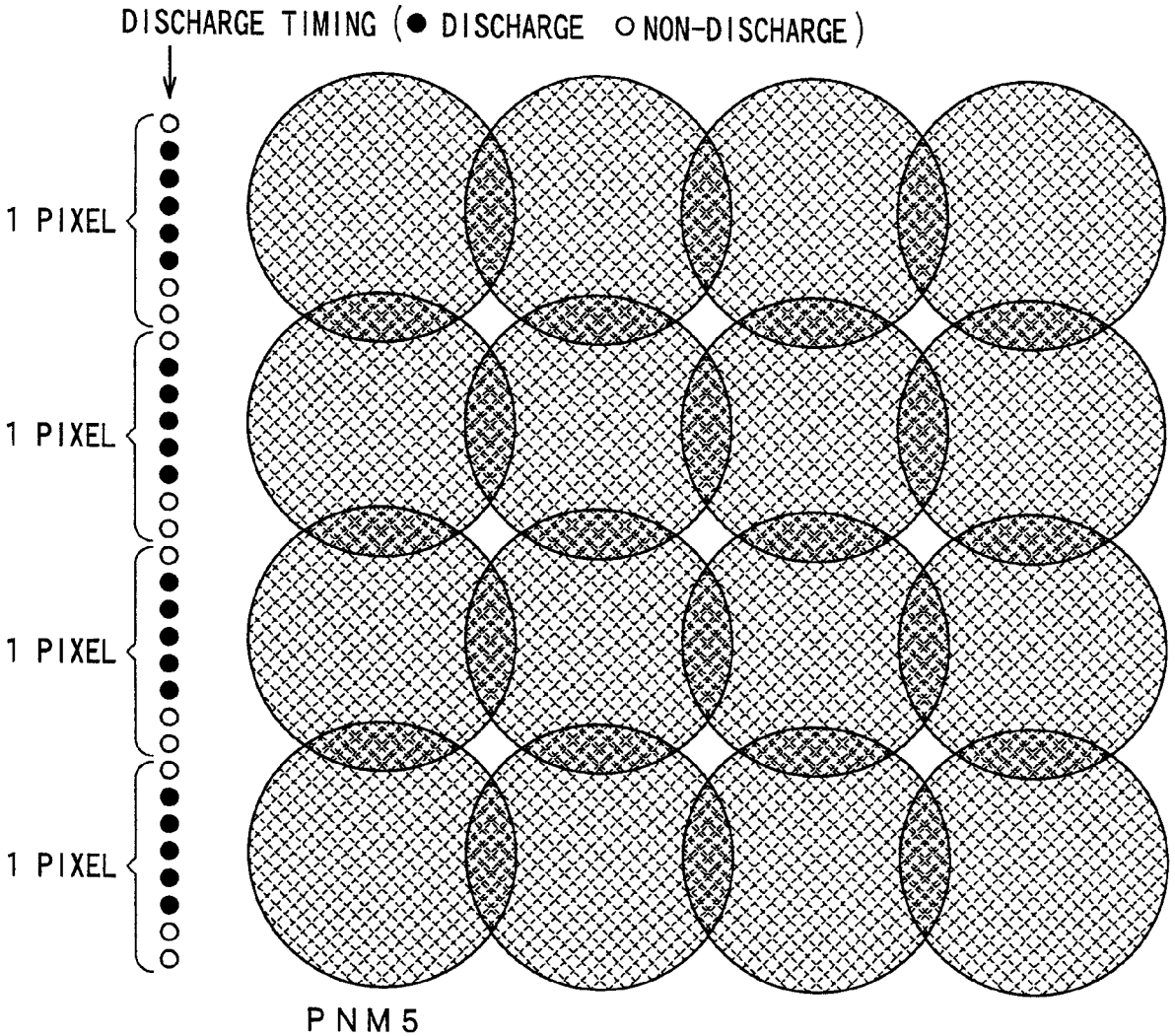
FIG. 23 is a view showing ink droplet discharge timing in the conventional PNM 5.
Figure 24:
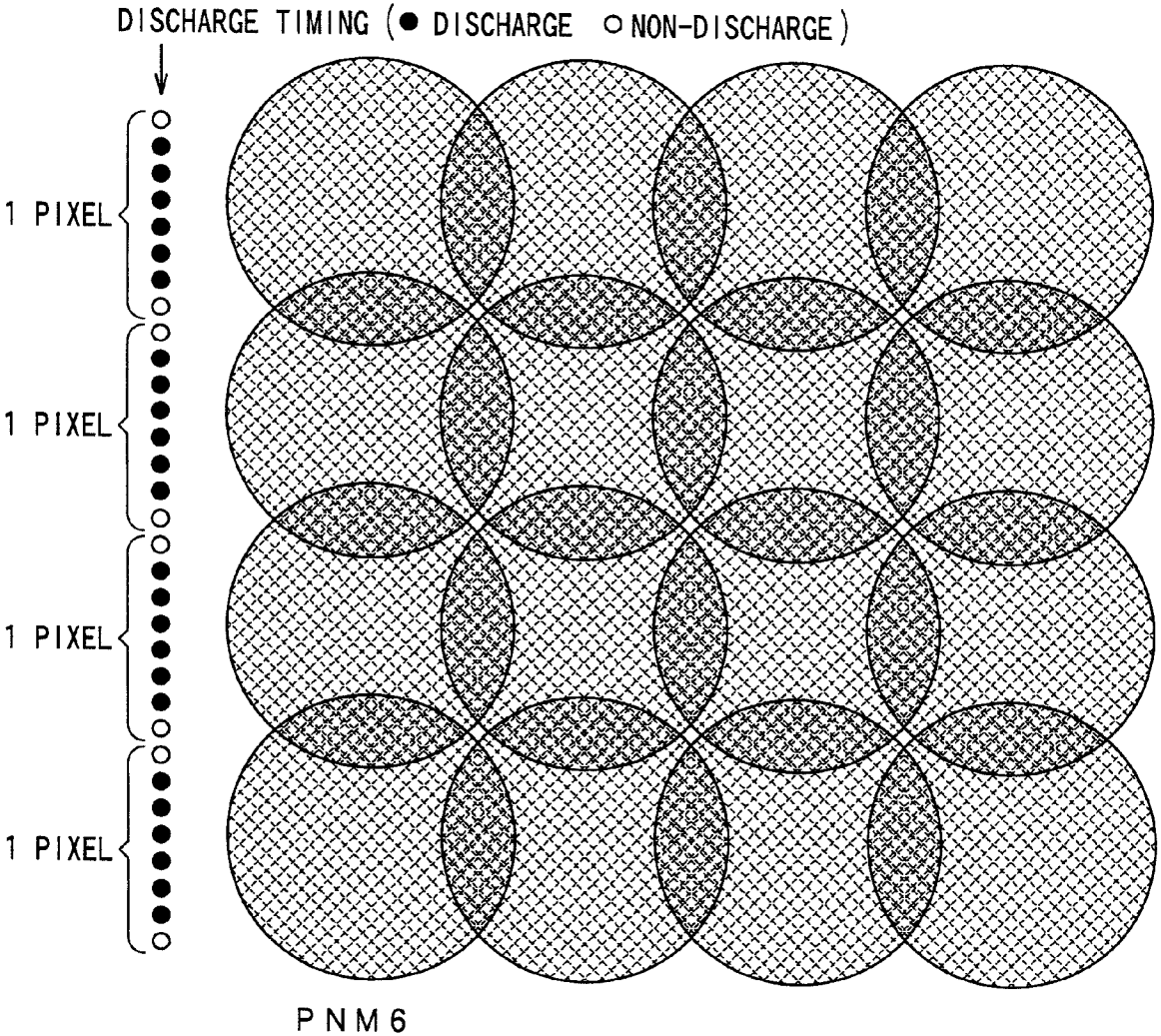
FIG. 24 is a view showing ink droplet discharge timing in the conventional PNM 6.
Figure 25:
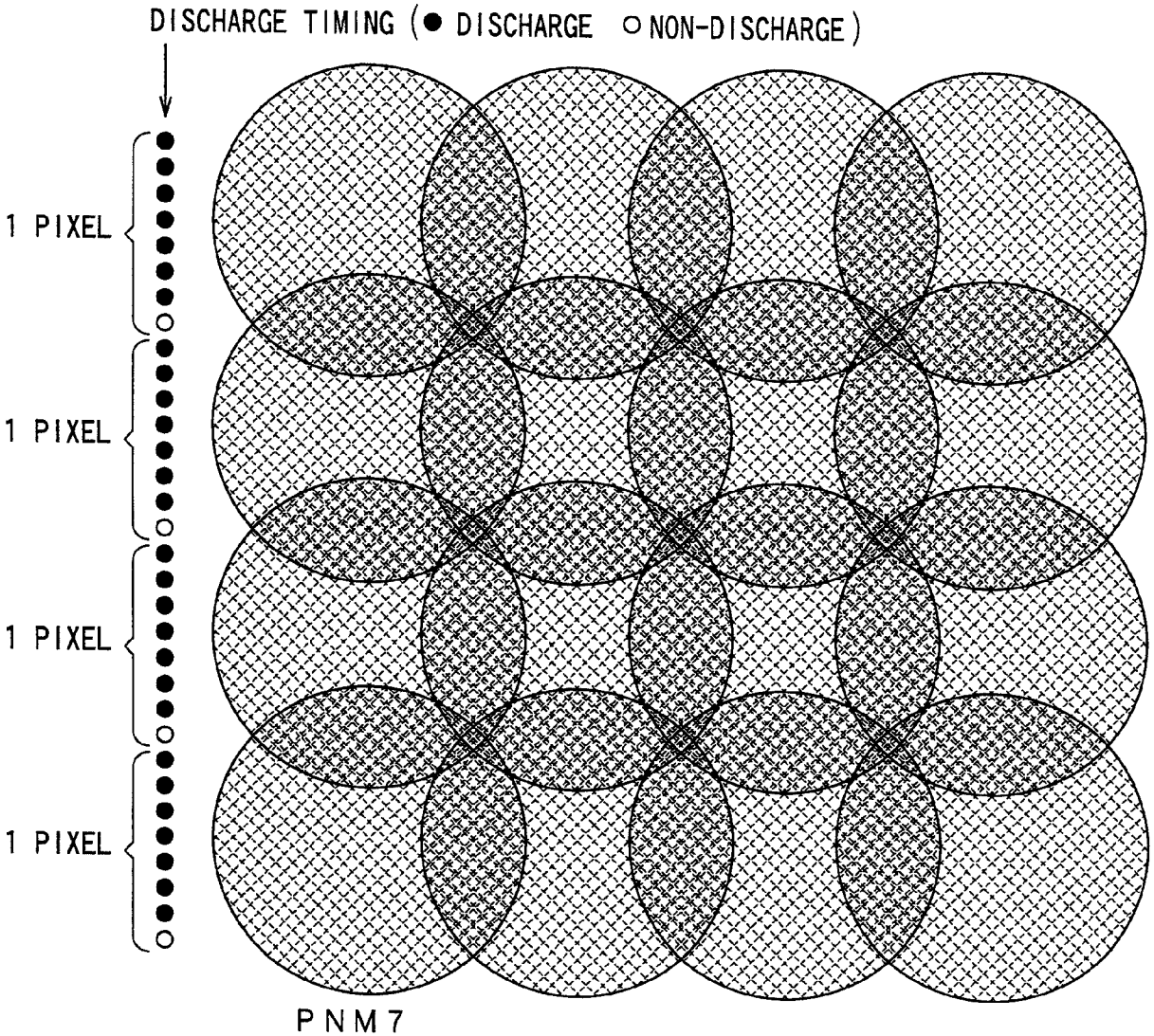
FIG. 25 is a view showing ink droplet discharge timing in the conventional PNM 7.
Figure 26:
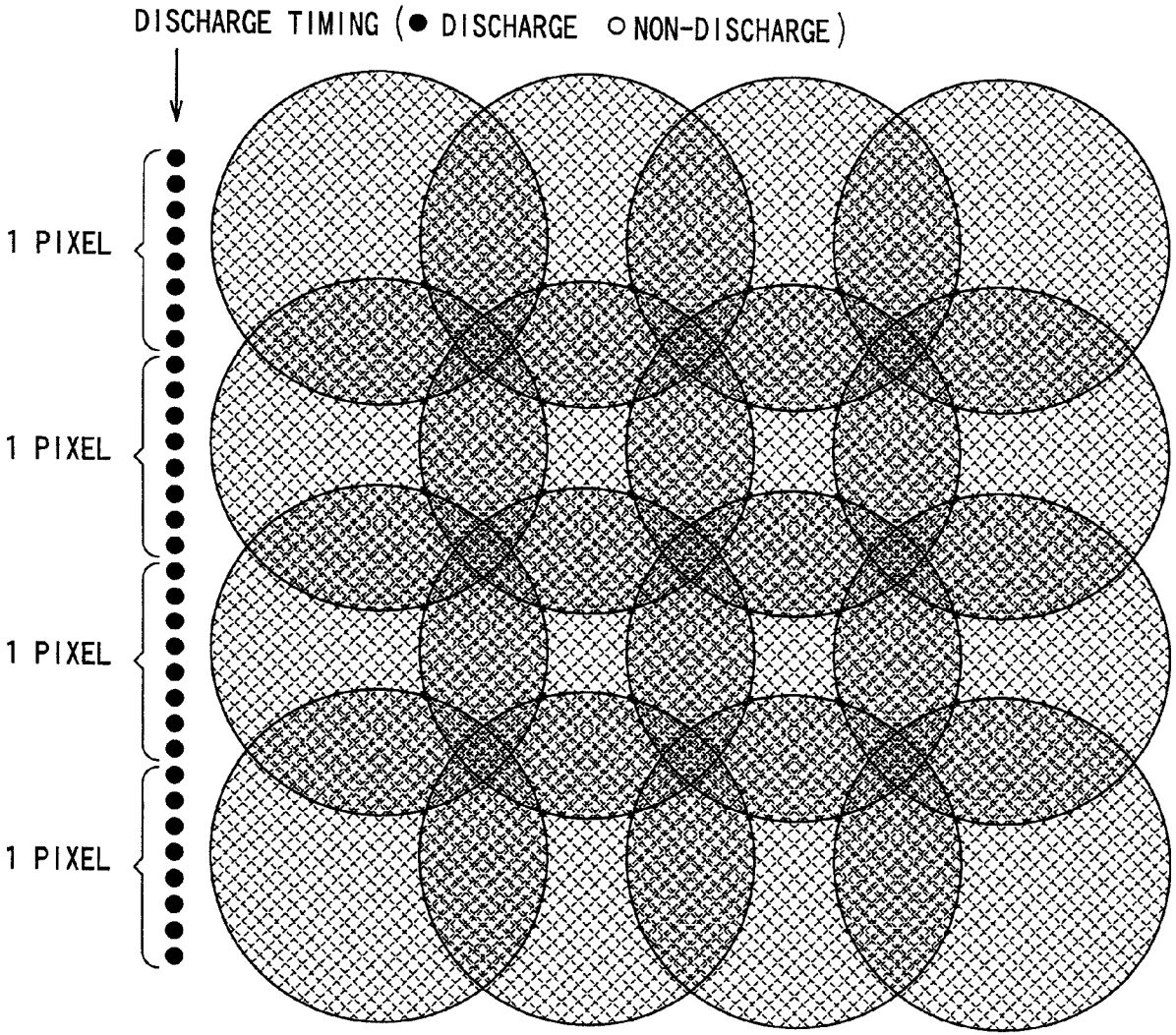
FIG. 26 is a view showing ink droplet discharge timing in the conventional PNM 8.

In this case, there are also instances where inks are pulled against each other, as shown in FIGS. 18A and 18B, in dependency upon the property of ink and paper so that shift of impact position is further enlarged. This is expansion of stripe taking place by surface tension of ink.

In the case where dot diameter is larger, i.e., in such cases that the number of droplets by PNM is 7~8, even if impact position is shifted a little, dots sufficiently overlap with each other. Accordingly, stripe becomes difficult to be conspicuous.

In view of the above, in the ink jet printer 100 of this embodiment, at the head controller 162, a head drive signal for allowing stripe taking place difficult to be conspicuous is generated on the basis of discharge timing table from recording data, kind of colors (CMYK) and position of pixel.

This head drive signal is a signal for shifting ink droplet discharge timing of the ink discharge unit of the line head 120 every one pixel in the print direction. Thus, at the line head 120, impact position of dot is changed to connect dots of two pixels so that there can result one large dot.

The previously described image to change impact position of dot to connect dots of two pixels so that there results one large dot will be explained below.

In the case where there is no influence such as accuracy and/or state of nozzle surface, etc. as previously described at the ink discharge unit of the line head 120 which carries out PNM drive and there is no shift at the impact position of dot, even if discharge timings every pixels are caused to be the same from the state where the number of droplets by PNM is 1 (PNM1) to the state where the number of droplets by PNM is 8 (PNM 8) as shown in FIGS. 19 to 26, stripe as previously described does not take place.

Figure 27:
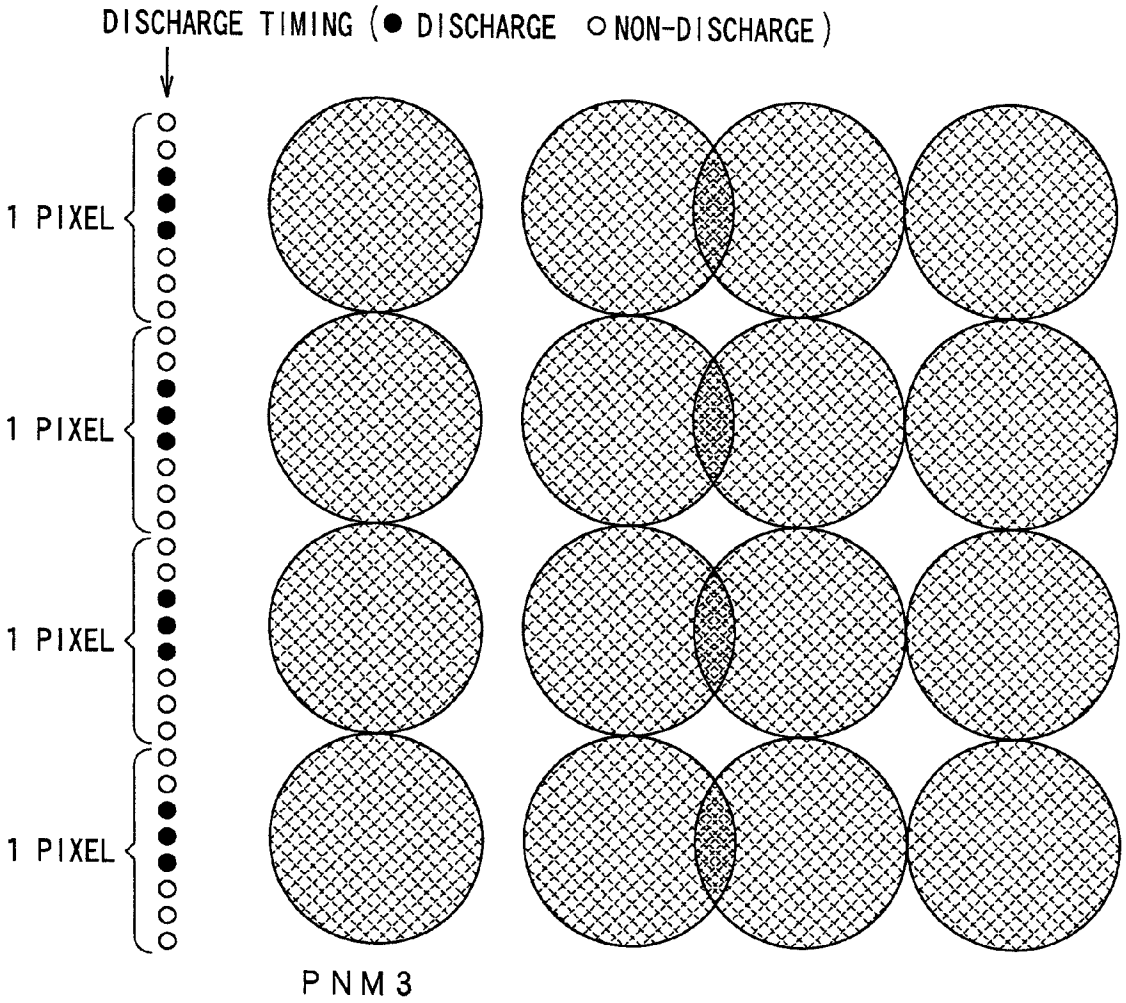
FIG. 27 is a view showing occurrence of stripe in PNM 3 when impact position is shifted from the primary position by influence such as accuracy of ink discharge unit and/or state of nozzle surface, etc.
Figure 28:
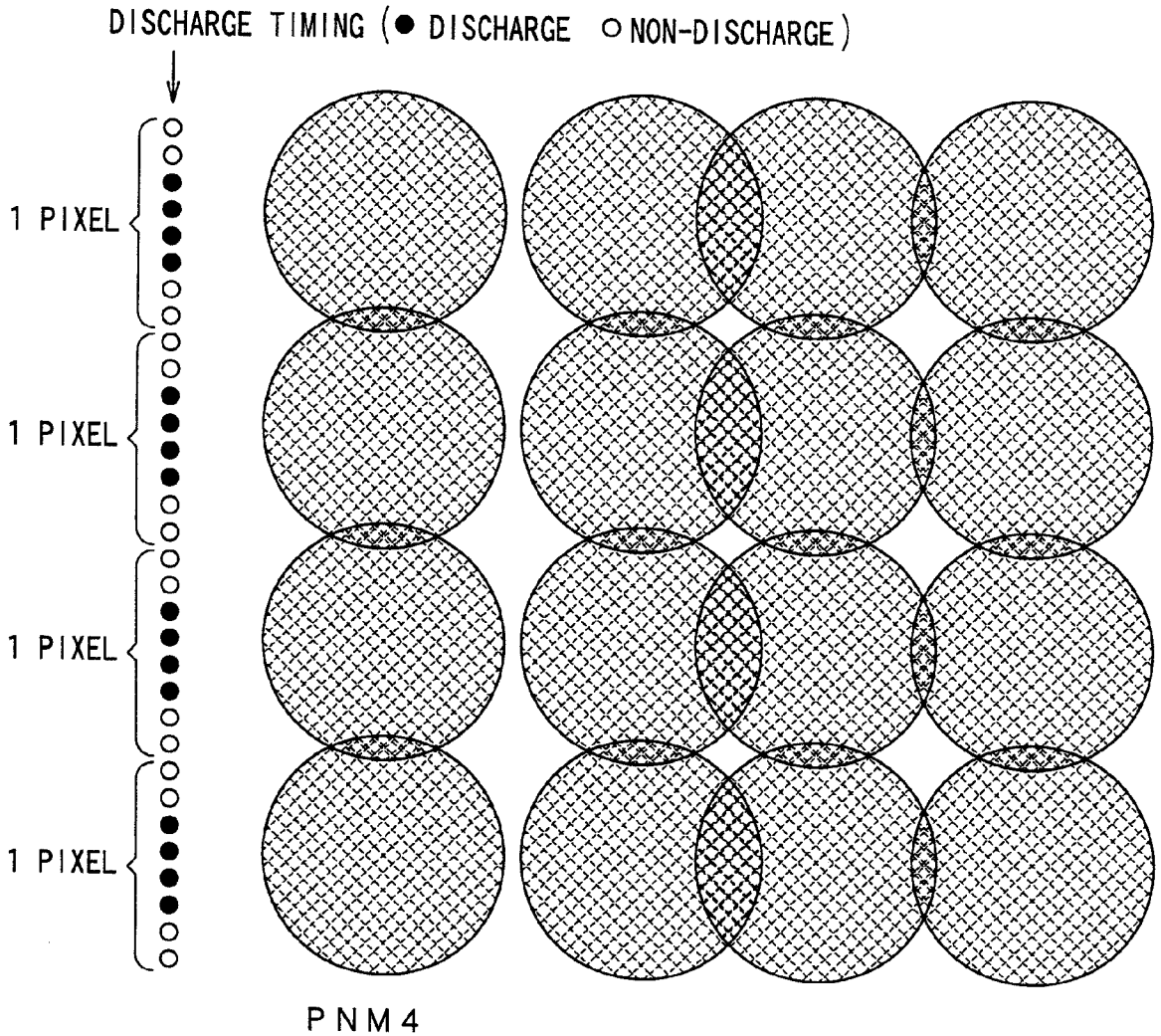
FIG. 28 is a view showing occurrence of stripe in PNM 4 when impact position is shifted from the primary position by influence such as accuracy of ink discharge unit and/or state of nozzle surface, etc.

When the impact position deviates (is shifted) from the primary position by influence such as accuracy of the ink discharge unit and/or state of the nozzle surface, etc. as previously described, there results conspicuousness as shown in FIGS. 27 and 28 at the time of a certain dot diameter, e.g., at the time of the number of droplets of 3 or 4 by PNM. Thus, the portion of white ground results in stripe.

Figure 29:
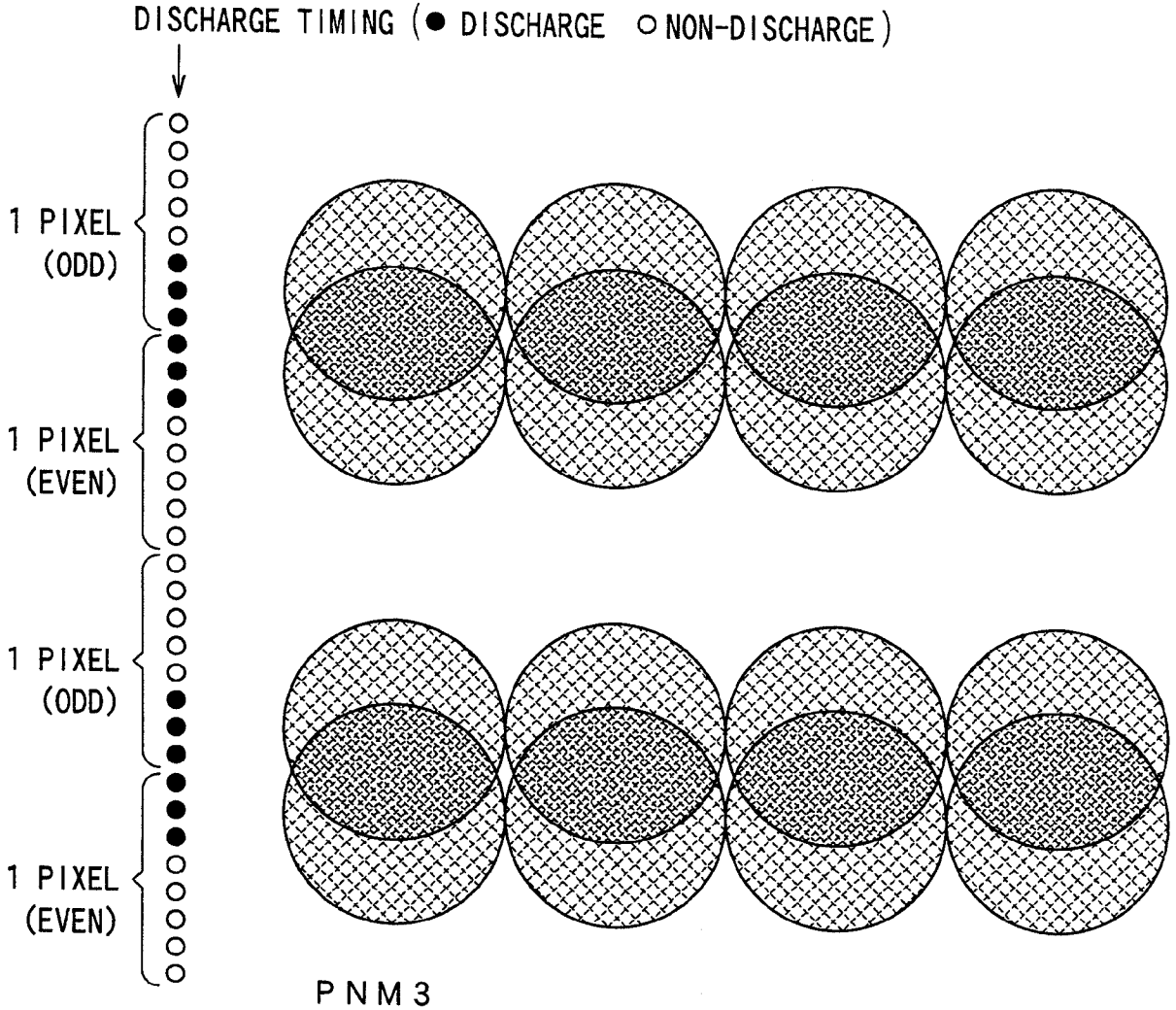
FIG. 29 is a view showing ink droplet discharge timing in PNM 3 of line head of an ink jet printer according to the present invention.
Figure 30:
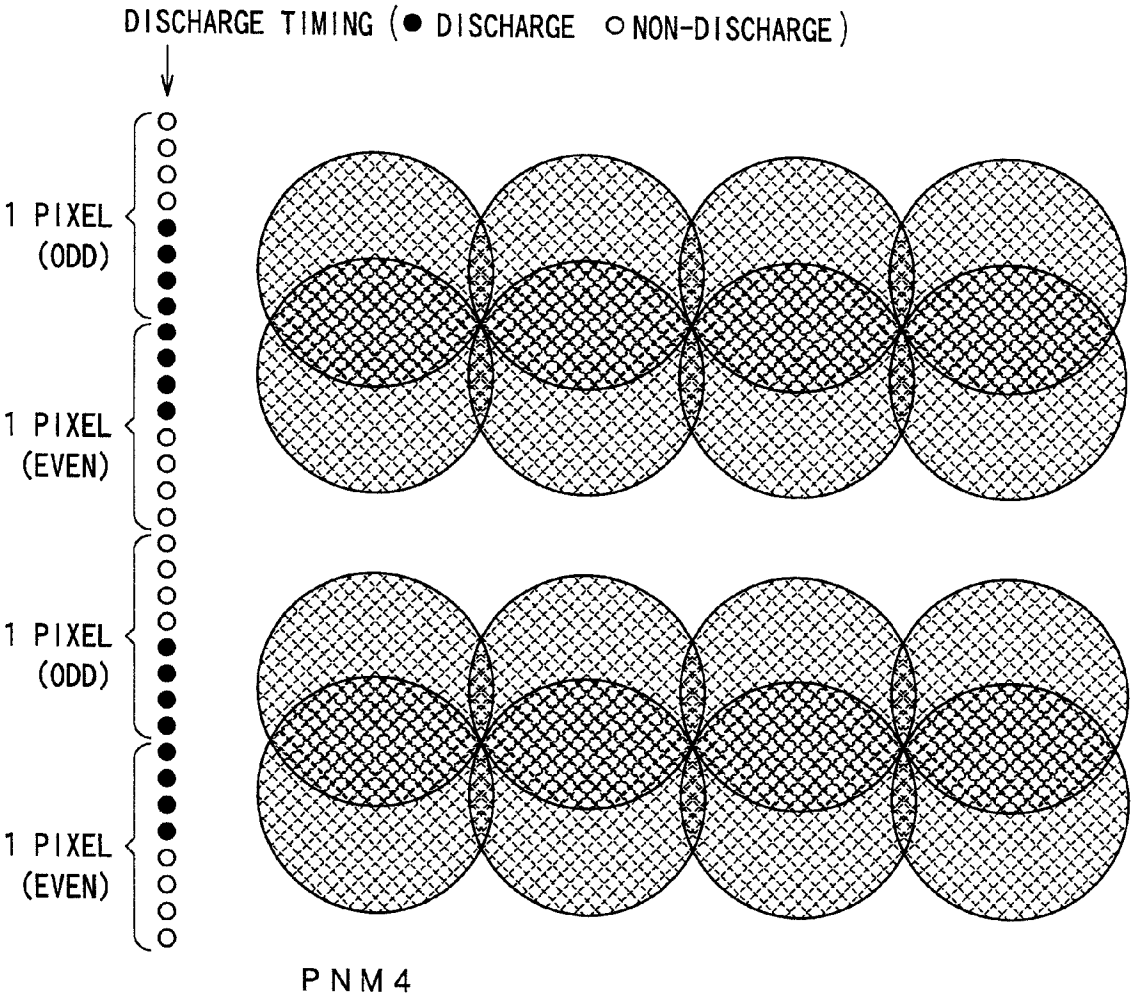
FIG. 30 is a view showing ink droplet discharge timing in PNM 4 of line head of the ink jet printer according to the present invention.

In view of the above, in the ink jet printer 100 to which the present invention is applied, ink droplet discharge timings of the ink discharge unit of the line head 120 are shifted every one pixel in print direction as shown in FIGS. 29 and 30. FIG. 29 is an ink droplet discharge timing at the time of the number of droplets of 3 by PNM (PNM 3), and FIG. 30 is an ink droplet discharge timing at the time of the number of droplets of 4 by PNM (PNM 4). In the case of PNM 3 of FIG. 29, e.g., discharge timing is caused to be last half 3 discharge at the time of odd one pixel, and that discharge timing is caused to be first half 3 discharge at the time of even one pixel. Thus, at odd pixel and even pixel, dots overlap with each other. In the case of PNM 4 shown in FIG. 30, e.g, discharge timing is caused to be last half 4 discharge at the time of odd one pixel, and that discharge timing is caused to be first half 4 discharge at the time of even one pixel. Thus, dots of odd pixels and even pixels are connected so that large dots are respectively formed as shown in FIG. 31 at PNM 3 and as shown in FIG. 32 at PNM 4.

Figure 33:
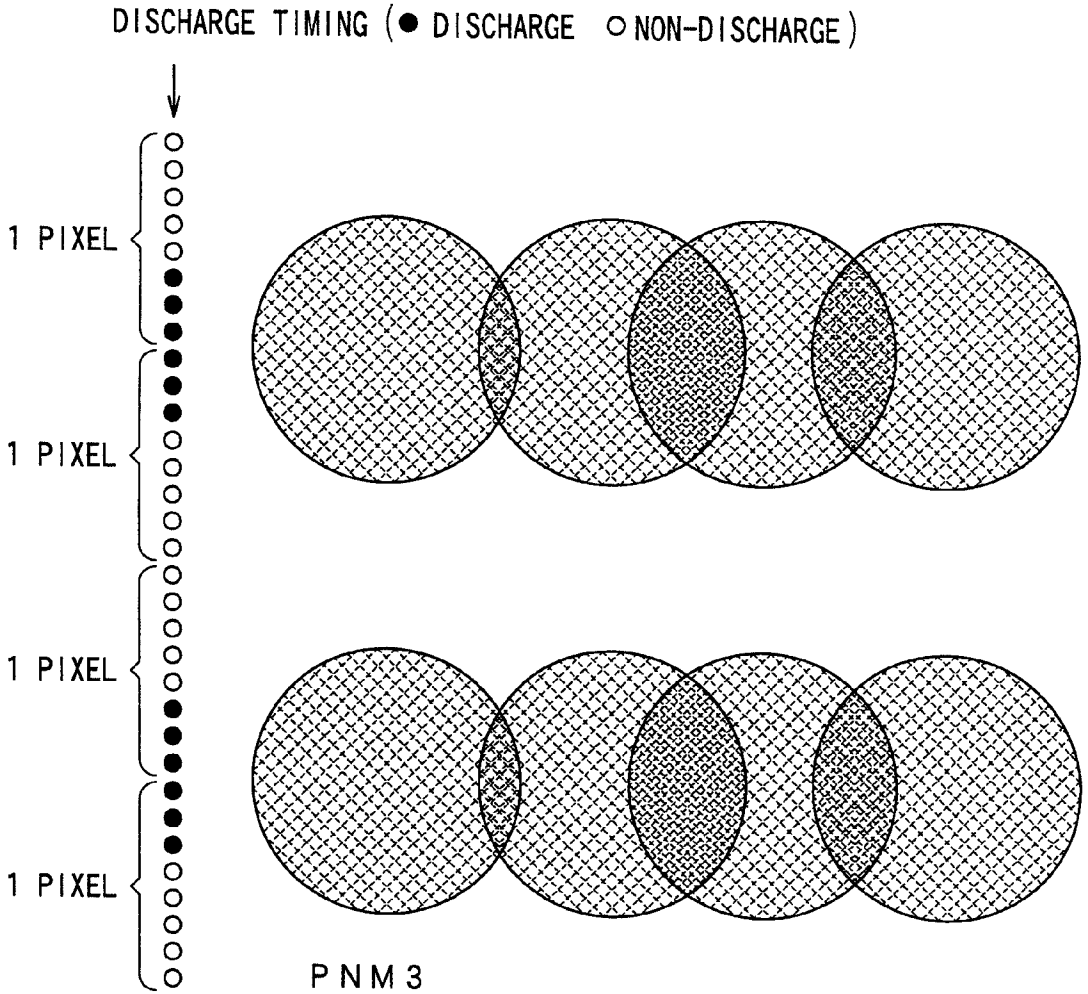
FIG. 33 is a view showing the state where dots are connected by ink droplet discharge timing in PNM 3 so that longitudinal stripe becomes difficult to be conspicuous.
Figure 34:
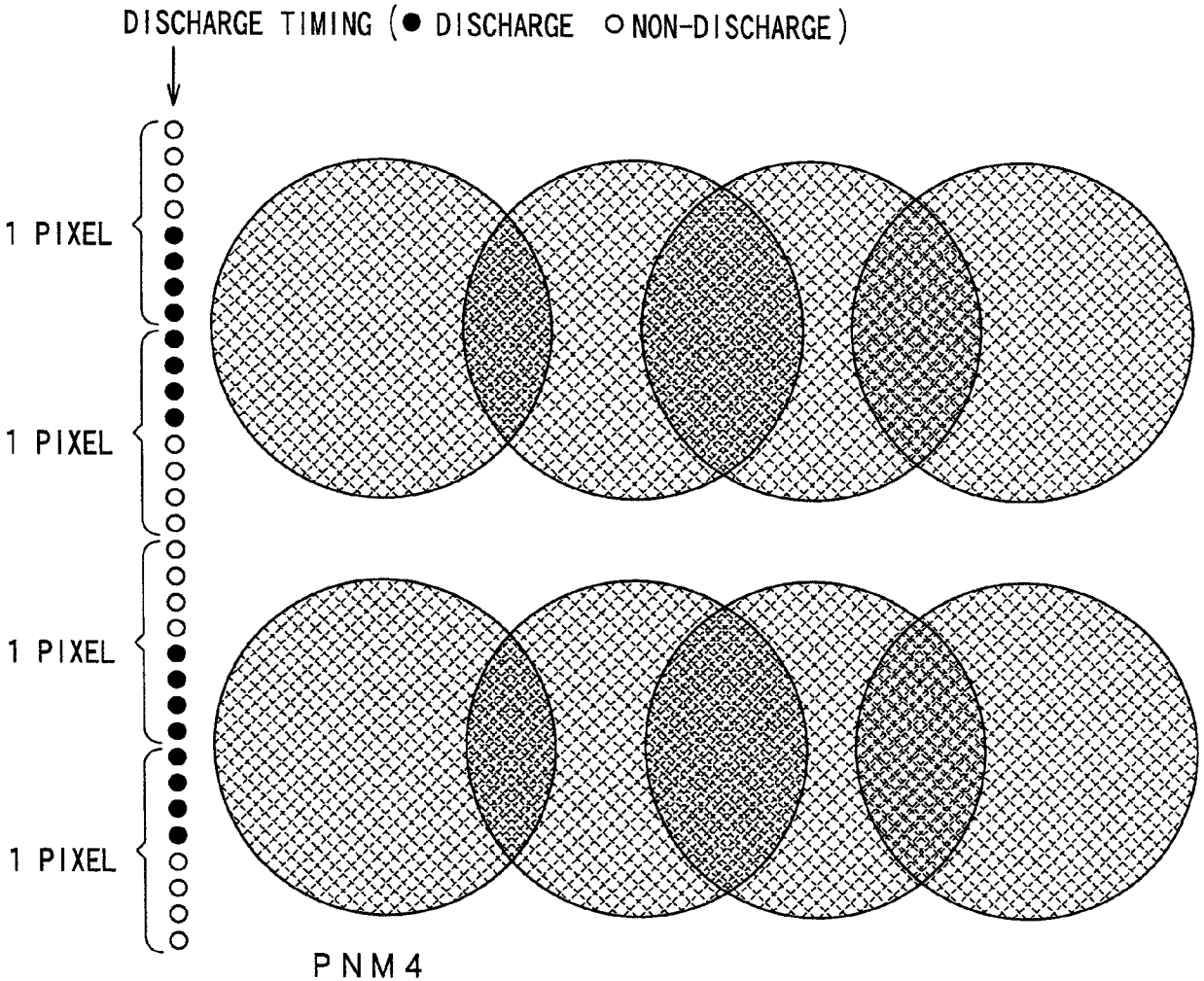
FIG. 34 is a view showing the state where dots are connected by ink droplet discharge timing in PNM 4 so that longitudinal stripe becomes difficult to be conspicuous.

As a result, even in the case as shown in FIGS. 27 and 28 such that impact position of ink is shifted and stripe takes place with a conventional hitting method, since portions overlapping with left and right dots sufficiently exist, there is no possibility that dots are separated from each other as shown in FIGS. 33 and 34 so that there can result the state where stripe becomes difficult to be conspicuous.

Then, the case where two kinds of inks of Cyan and Magenta will be explained. Also in this case, by the above-described method, there can result the state where stripe becomes difficult to be conspicuous. However, when discharge timings are shifted in the same manner with respect to both Cyan and Magenta, large dots take place at the same position. As a result, the possibility that inks are stained each other or overflow on print paper becomes high.

Figure 31:
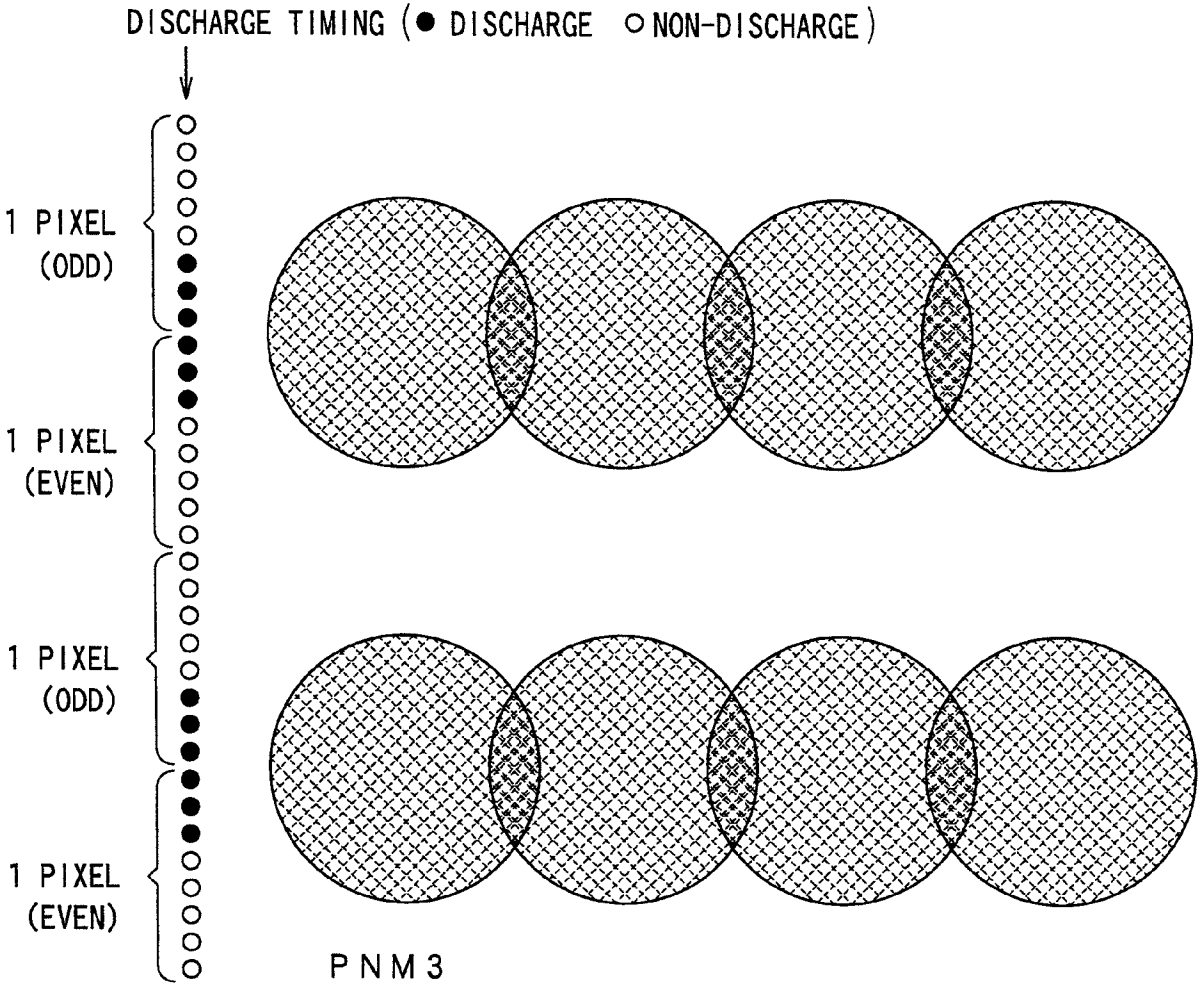
FIG. 31 is a view showing the state where dots are connected by ink droplet discharge timing in PNM 3.
Figure 32:
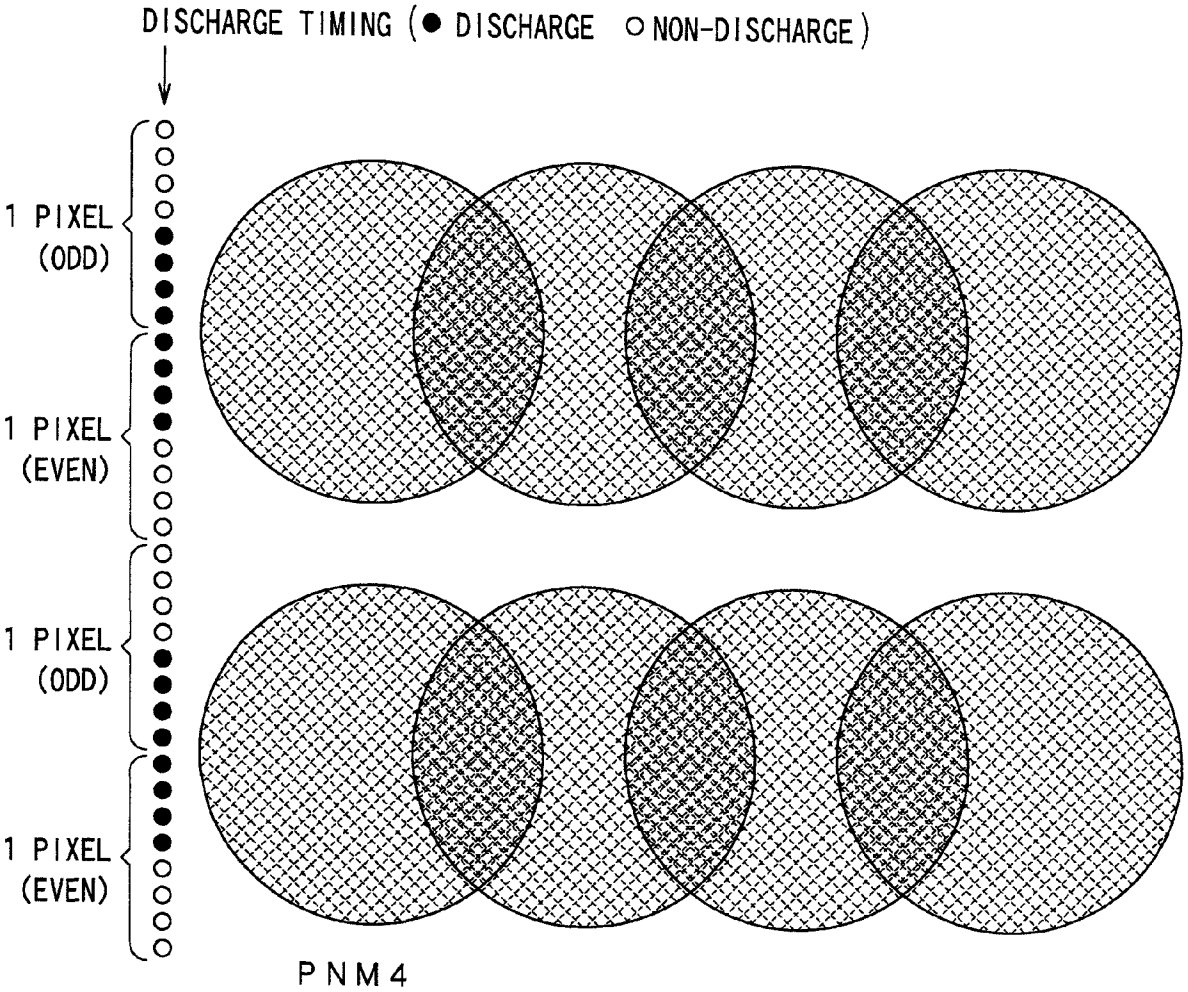
FIG. 32 is a view showing the state where dots are connected by ink droplet discharge timing in PNM 4.
Figure 35:
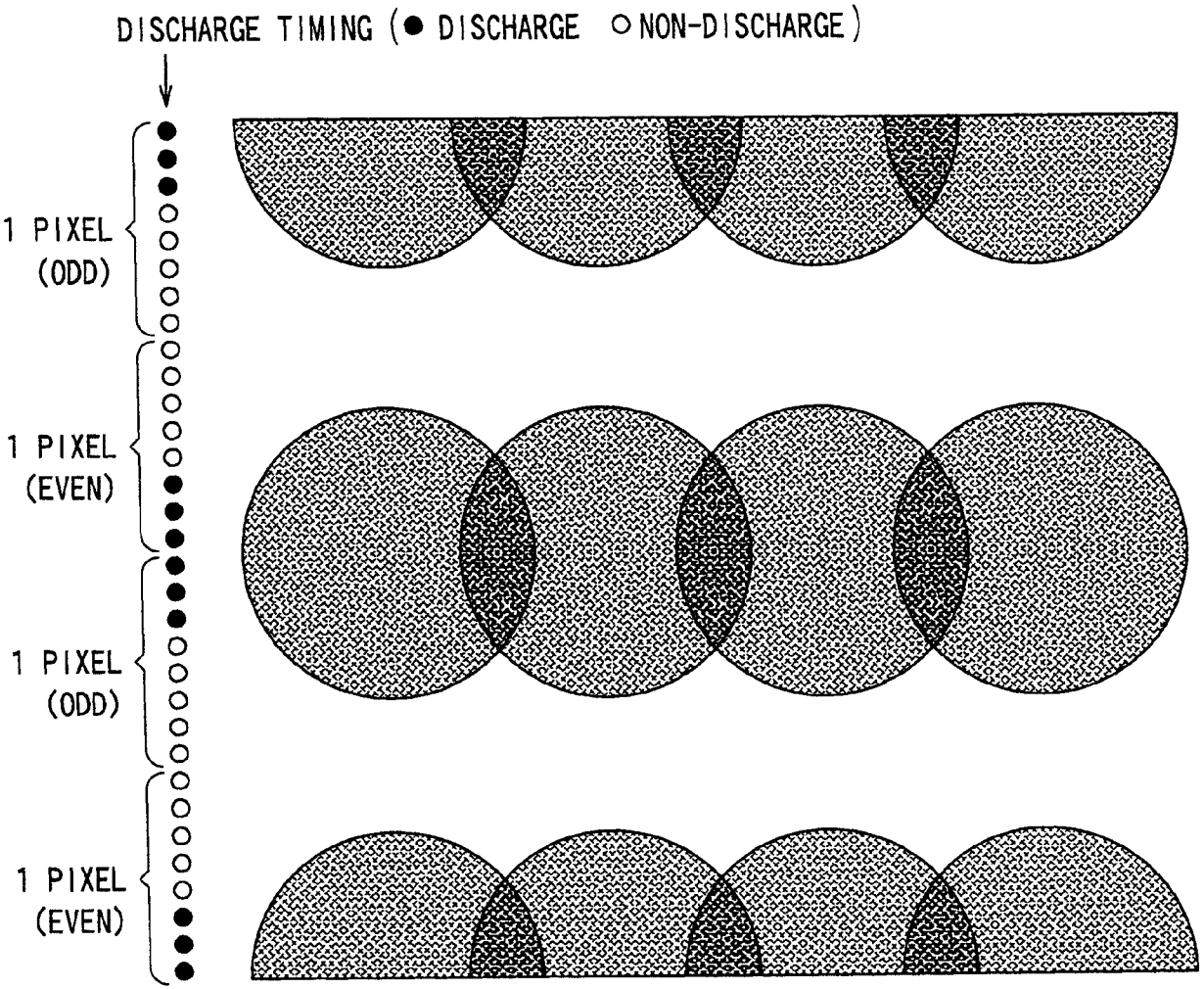
FIG. 35 is a view showing ink droplet discharge timing in PNM 3 of Magenta in the case where two kinds of inks of Cyan and Magenta are used.

In view of the above, ink droplet discharge timing of Cyan at the time of PNM 3 is caused to be latter half 3 discharge at the time of odd one pixel and is caused to be first half 3 discharge at the time of even one pixel as shown in FIG. 31, and ink droplet discharge timing of Magenta is caused to be first half 3 discharge at the time of odd one pixel and is caused to be latter half 3 discharge at the time of even one pixel as shown in FIG. 35. Ink droplet discharge timings are further shifted with respect to Cyan and Magenta.

Figure 36:
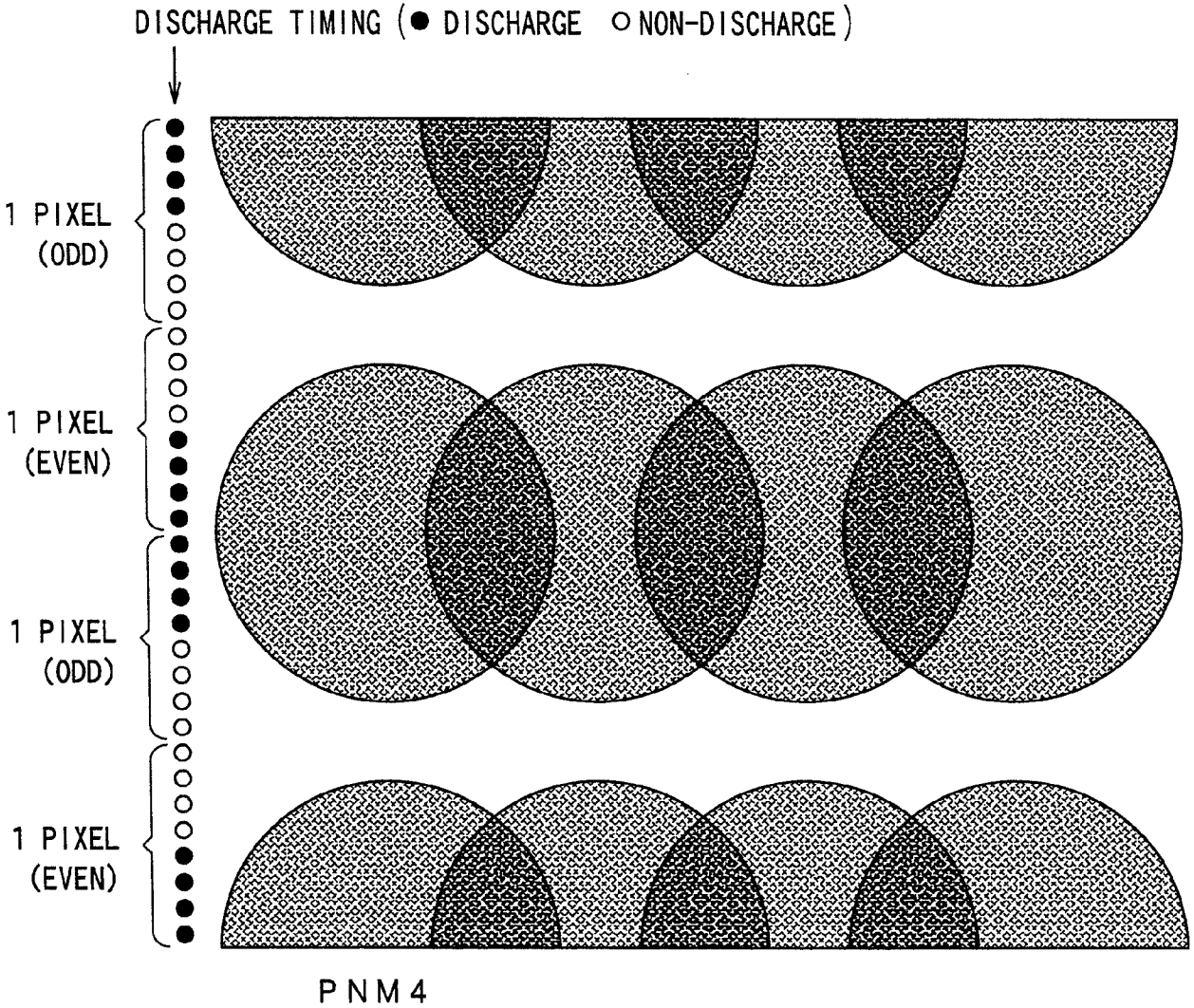
FIG. 36 is a view showing ink droplet discharge timing in PNM 4 of Magenta in the case where two kinds of inks of Cyan and Magenta are used.

Ink droplet discharge timing of Cyan at the time of PNM 4 is caused to be latter half 4 discharge at the time of odd one pixel and is caused to be first half 4 discharge at the time of even one pixel as shown in FIG. 32, and ink droplet discharge timing of Magenta is caused to be first half 4 discharge at the time of odd one pixel, and is caused to be latter half 4 discharge at the time of even one pixel as shown in FIG. 36. Ink droplet discharge timings are further shifted with respect to Cyan and Magenta.

Figure 37:
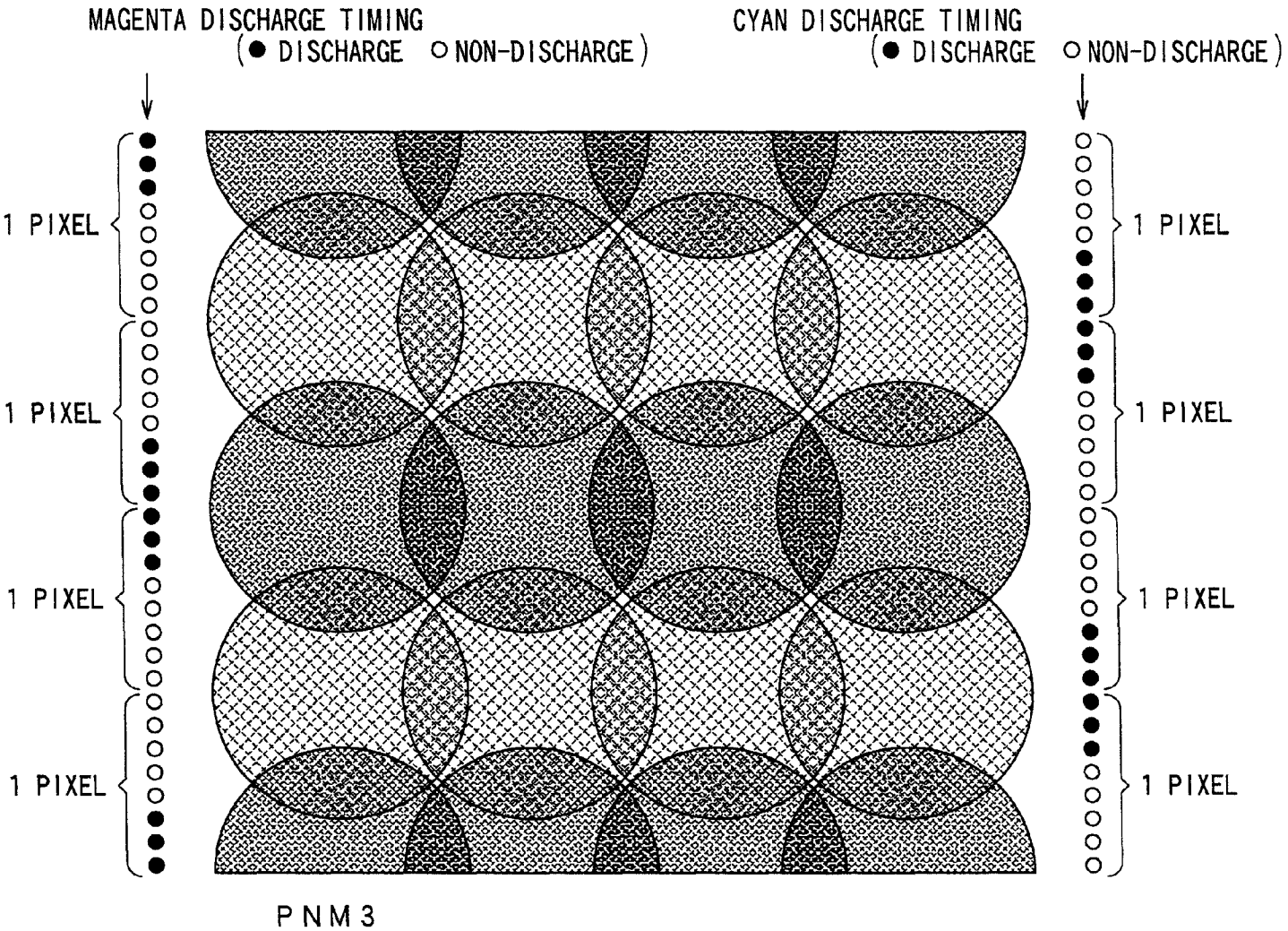
FIG. 37 is a view showing ink droplet discharge timing in PNM 3 of Magenta and Cyan in the case where two kinds of inks of Cyan and Magenta are used.
Figure 38:
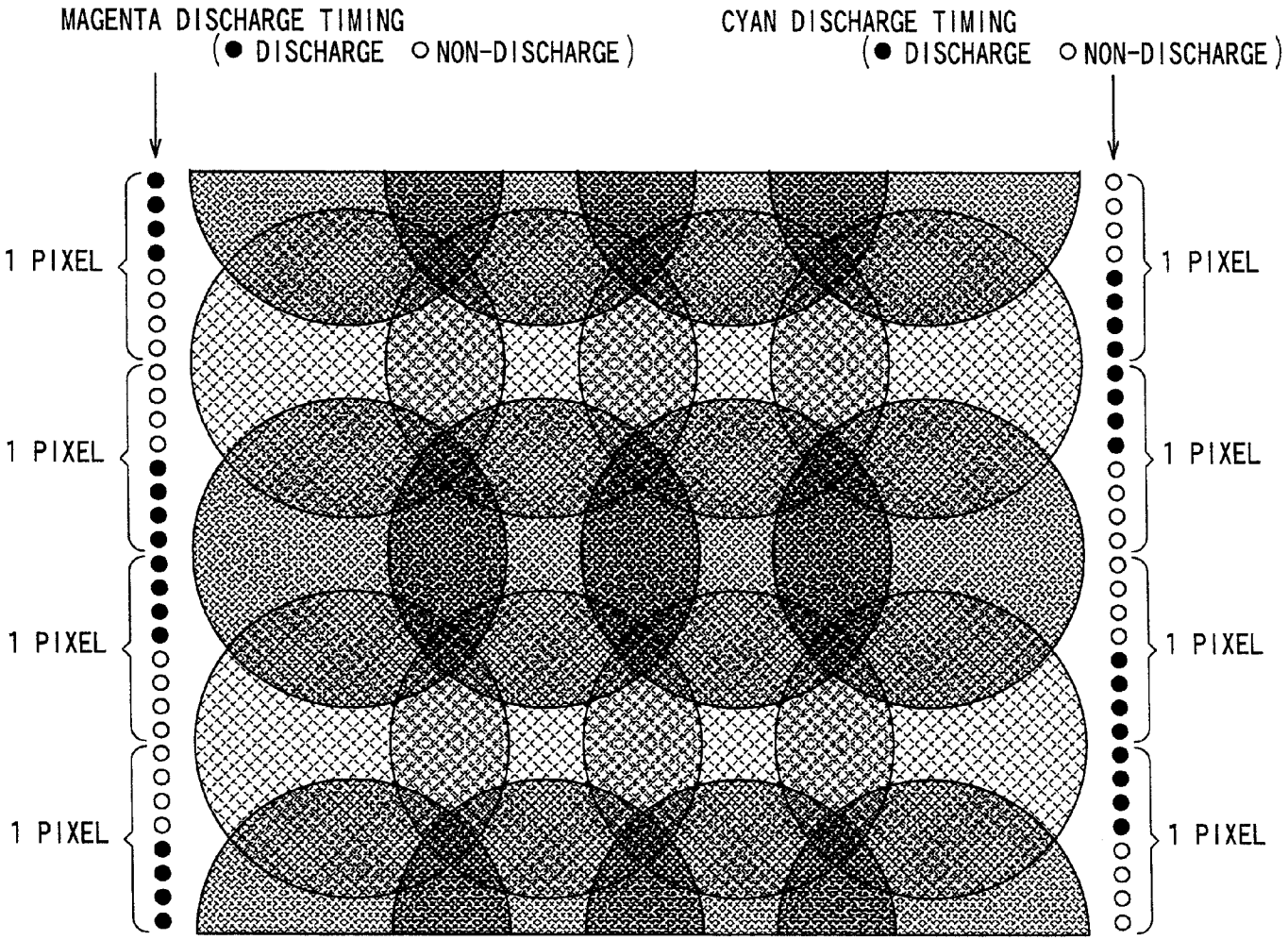
FIG. 38 is a view showing ink droplet discharge timing in PNM 4 of Magenta and Cyan in the case where two kinds of inks of Cyan and Magenta are used.

Thus, since the position where large dot takes place as in the case of FIG. 37 (PNM 3) and FIG. 38 (PNM 4) are alternately produced with respect to Magenta and Cyan, the possibility that inks are stained with each other or overflow can be lowered.

It is to be noted that, with respect to color in which even if stripe can be observed, it is difficult to be recognized as print result such as Yellow, etc., print processing at discharge timing as in the prior art may be implemented.

In addition, while the line head of the type for changing dot diameter by PNM is mentioned in this embodiment, line head of the type capable of discharging different ink liquid quantities may be used.

As explained above, in accordance with the inkjet printer 100 of this embodiment, discharge timings of ink droplet are shifted every one pixel in print direction in carrying out 1 path print to thereby change impact position of dot to connect dots of two pixels so that there results one dot to have ability to convert dot pattern where stripe at dot diameter in which stripe is apt to be conspicuous is apt to be conspicuous into print at dot diameter in which stripe is difficult to be conspicuous. Accordingly, it permits stripe to become difficult to be conspicuous.

In this instance, in the case where thin dot pattern where stripe is difficult to be conspicuous is printed, it is rare that dots are continuously hit in the print direction. Accordingly, there hardly take place that two dots are connected. Thus, it is possible to carry out print by primary dot diameter.

On the other hand, in the case of dot pattern like solid plane portion where stripe is apt to be conspicuous, two dots are automatically connected so that there results large dot where stripe is not conspicuous. Accordingly, it permits stripe to become difficult to be conspicuous.

In this case, it is feared that dots are connected so that there results large dot, whereby feeling of granulation is increased somewhat. However, in the case of thin dot pattern where feeling of granulation is particularly anxious, it is rare that dots are continuously hit. Accordingly, dot is caused to have primary size. As a result, there is no possibility that feeling of granulation is increased more than necessity.

In accordance with the ink jet printer 100 of this embodiment, in the case of the ink jet printer having plural dot diameters, discharge timings of ink droplet are shifted every one pixel in the print direction only in the case of dot diameter where stripe is apt to be conspicuous to thereby change impact position of dot to connect dots of two pixels so that there results one large dot where stripe is not conspicuous. Accordingly, it permits stripe to become difficult to be conspicuous, and sufficiently large dots or sufficiently small dots in which stripe is difficult to be conspicuous are hit onto primary position, thereby making it possible to suppress degradation of resolution by shift of impact position as minimum as possible.

In accordance with the ink jet printer 100 of this embodiment, way of shifting impact position is changed by color at the time of color print, thereby making it possible to shift the position where two dots are connected so that there results one large dot. Accordingly, it is possible to reduce occurrence of the problem that inks of different colors are concentrated on one portion so that inks are stained or overflow.

In the ink jet printer to which the present invention as described above is applied, even if print is carried out by 1 pass, stripe becomes difficult to be conspicuous. Accordingly, it becomes unnecessary to print a portion or the entirety of image by several scanning operations. Thus, it is possible to carry out print by one scanning operation.

As a result, print speed can be increased, and burden on the apparatus can be lightened. Occurrence of noise can be suppressed, and sort of data for driving the head becomes simple. Further, print at only one scanning operation by the line head can be also carried out.

While explanation has been given in this embodiment by taking the practical example where the present invention is applied to line head which carries out print by one scanning operation by line head, the present invention can be applied also to an ink jet printer using printer head which carries out reciprocating movement in the main scanning direction.

Figure 39:
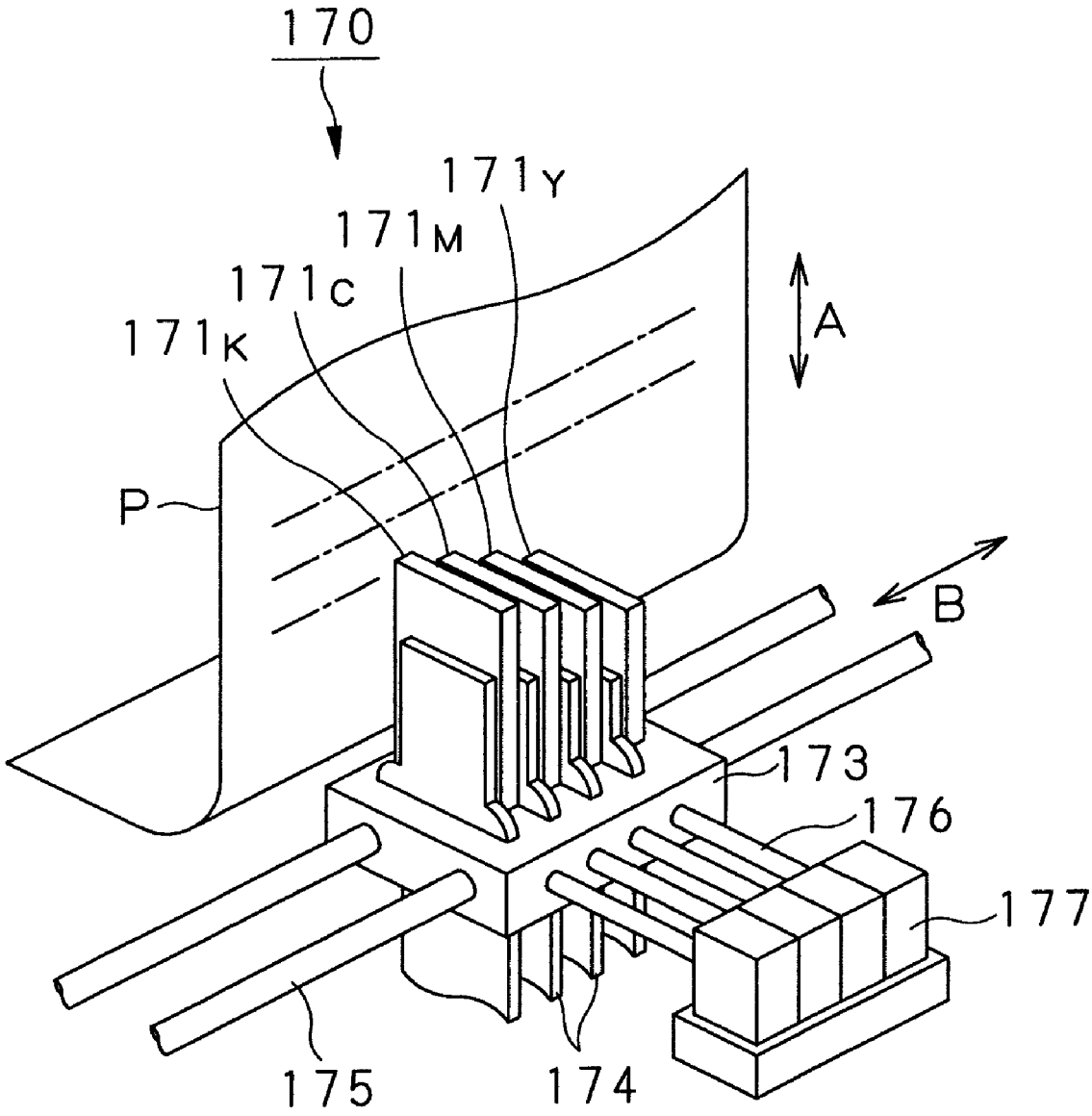
FIG. 39 is an external appearance perspective view of a further practical example of ink jet printer.

This ink jet printer 170 comprises, as shown in FIG. 39, print heads $\mathbf{171}_K$, $\mathbf{171}_C$, $\mathbf{171}_M$, $\mathbf{171}_Y$ which respectively discharge inks of Black (K), Cyan (C), Magenta (M) and Yellow (Y), a carriage unit 173 adapted so that the print heads $\mathbf{171}_K$, $\mathbf{171}_C$, $\mathbf{171}_M$, $\mathbf{171}_Y$ are attached to move these print heads $\mathbf{171}_K$, $\mathbf{171}_C$, $\mathbf{171}_M$, $\mathbf{171}_Y$ in the main scanning direction, flexible printed boards 174 which deliver drive signals for driving the print heads $\mathbf{171}_K$, $\mathbf{171}_C$, $\mathbf{171}_M$, $\mathbf{171}_Y$, guide rails 175 for guiding the carriage unit 173, and a group of ink tanks 177 for supplying ink to respective print heads through ink supply pipes 176.

The group of ink tanks 177 supply inks of Black (K), Cyan (C), Magenta (M), Yellow (Y) to respective print heads through the ink supply pipes 176.

The print heads $\mathbf{171}_K$, $\mathbf{171}_C$, $\mathbf{171}_M$, $\mathbf{171}_Y$ are print heads of the ink jet type using, e.g., piezo element or thermal element, and plural ink discharge units are provided for the purpose of carrying out high speed print similarly to the line head 120. These print heads $\mathbf{171}_K$, $\mathbf{171}_C$, $\mathbf{171}_M$, $\mathbf{171}_Y$ carry out processing based on print method with respect to dots continuously printed in sub-scanning direction at plural ink discharge units on the basis of drive signals supplied from the head controller through the flexible printed boards 174 to selectively discharge inks of Black (K), Cyan (C), Magenta (M) and Yellow (Y) from respective plural ink discharge units onto recording paper P to carry out print.

While explanation has been given as described above in connection with several embodiments, the present invention is not limited to the above-described embodiments, but various modifications can be made.

For example, while explanation has been given in the above-described example by taking the example where the present invention is applied to the liquid discharge apparatus and the liquid discharge method using the thermal system or the piezo-electric element, the present invention can be applied to any energy generating elements which generate energy for discharge of droplets without being limited thereto.

Further, while explanation has been given in the above-described explanation by taking the example where the present invention is applied to the printer, it is a matter of course that the present invention can be also applied to image forming apparatus such as FAX, copy machine, etc. and image forming method. In addition, the present invention is not limited to image forming apparatus, etc. as described above, and can be applied to various liquid discharge apparatuses. For example, the present invention can be also applied to an apparatus adapted for discharging DNA contained solution for detecting bio-sample.

While the invention has been described in accordance with certain preferred embodiments thereof illustrated in the accompanying drawings and described in the above description in detail, it should be understood by those ordinarily skilled in the art that the invention is not limited to the embodiments, but various modifications, alternative constructions or equivalents can be implemented without departing from the scope and spirit of the present invention as set forth and defined by the appended claims.

INDUSTRIAL APPLICABILITY

The liquid discharge apparatus and the liquid discharge method according to the present invention permit stripes peculiar to nozzle to be difficult to be conspicuous even when a portion or the entirety of image is printed by one scanning operation.

The invention claimed is:

1. A liquid discharge apparatus including a liquid discharge head having a liquid discharge unit for discharging droplets, and liquid discharge head control means for controlling the liquid discharge head to discharge droplet from the liquid discharge unit onto recording medium surface, wherein the liquid discharge head includes plural ones of the liquid discharge units in a direction perpendicular to movement of a recording medium where the recording medium is relatively moved with respect to the liquid discharge head; and wherein the liquid discharge head control means serves to allow discharge timings of the droplet to be different every one pixel in the movement direction of the recording medium, wherein the control means alters discharge timings for ink ejection are shifted in the print feed direction only when a shift in nominal pixel generation is likely to result in conspicuous erroneous pattern, the discharge timing being shifted so that adjacent pixels in a print feed direction are caused to overlap thereby eliminating the potential for a visible line in the printed image, and further wherein recorded data is used by the control means in order to eliminate undesired stripes by altering discharge timings and further wherein dots of even pixels and dots of odd pixels are selectively connected based upon the recorded data in order to eliminate the undesired stripes.

2. The liquid discharge apparatus as set forth in claim 1, wherein the liquid discharge head control means carries out a control so as to constitute droplet per one pixel by plural number of liquid discharge operations, and controls the number of liquid discharge operations to thereby control dot diameter by the droplet per one pixel.

3. The liquid discharge apparatus as set forth in claim 1, wherein the liquid discharge head control means carries out a control so as to constitute droplet per one pixel by plural number of liquid discharge operations, and controls the number of liquid discharge operations to thereby control dot diameter by the droplet per one pixel, and to serve to allow discharge timings of the plural liquid discharge operations which constitute the droplet per one pixel to be different every one pixel in movement direction of the recording medium.

4. The liquid discharge apparatus as set forth in claim 1, wherein the liquid discharge head control means carries out a control so as to constitute droplet per one pixel by plural number of liquid discharge operations, and controls the number of liquid discharge operations to thereby control dot diameter by the droplet per one pixel, whereby in the case where the droplet per one pixel is constituted by the number of liquid discharge operations determined in advance, discharge timings of the plural droplet discharge operations which constitute the droplet per one pixel are caused to be different every one pixel in movement direction of the recording medium.

5. The liquid discharge apparatus as set forth in claim 4, wherein the number of ink discharge operations determined in advance is the number of liquid discharge operations where shift of impact position of the droplet per one pixel is conspicuous.

6. The liquid discharge apparatus as set forth in claim 1, wherein the liquid discharge head control means controls liquid quantity of droplet per one pixel, and controls liquid quantity of the droplet to thereby control dot diameter by the droplet per one pixel.

7. The liquid discharge apparatus as set forth in claim 1, wherein the liquid discharge head control means controls liquid quantity of droplet per one pixel, and controls liquid quantity of the droplet to thereby control dot diameter by the droplet per one pixel, whereby in the case where the droplet per one pixel is constituted by liquid quantity of droplet determined in advance, discharge timings of the droplet are caused to be different every one pixel in movement direction of the recording medium.

8. The liquid discharge apparatus as set forth in claim 7, wherein liquid quantity of the droplet determined in advance is liquid quantity where shift of impact position of the droplet per one pixel is conspicuous.

9. The liquid discharge apparatus as set forth in claim 1, wherein the liquid discharge head comprises the plural liquid discharge units in a direction perpendicular to movement direction of the recording medium and in a manner extending over width more than width where image can be formed.

10. A liquid discharge apparatus including liquid discharge heads each having a liquid discharge unit for discharging droplet by plural colors, and including liquid discharge head control means for controlling the liquid discharge heads of respective colors to discharge droplets of respective colors from the liquid discharge units of respective colors onto recording medium surface to thereby carry out color image formation, wherein the liquid discharge heads of respective colors include plural ones of the liquid discharge units of respective colors in a direction perpendicular to movement direction of a recording medium where the recording medium is relatively moved with respect to the liquid discharge head; and wherein the liquid discharge head control means of respective colors serves to allow discharge timings of the droplets of respective colors in movement direction of the recording medium to be different in accordance with respective colors every one pixel in the movement direction of the recording medium, wherein discharge timings for ink ejection are shifted in the print feed direction only when a shift in nominal pixel generation is likely to result in conspicuous erroneous pattern, the discharge timing being shifted so that adjacent pixels in a print feed direction are caused to overlap thereby eliminating the potential for a visible line in the printed image, and further wherein recorded data is used by the control means in order to eliminate undesired stripes by altering discharge timings and further wherein dots of even pixels and dots of odd pixels are selectively connected based upon the recorded data in order to eliminate the undesired stripes.

* * * * *